US011781841B2

(12) United States Patent
Berggren et al.

(10) Patent No.: US 11,781,841 B2
(45) Date of Patent: Oct. 10, 2023

(54) WING ARRANGEMENT, A PROJECTILE, A METHOD FOR DEPLOYING A WING BLADE, A USE AND A METHOD FOR ASSEMBLY

(71) Applicant: SAAB AB, Linköping (SE)

(72) Inventors: Joakim Berggren, Örebro (SE); David Brocker, Karlskoga (SE)

(73) Assignee: SAAB AB, Linkoping (SE)

( * ) Notice: Subject to any disclaimer, the term of this patent is extended or adjusted under 35 U.S.C. 154(b) by 0 days.

(21) Appl. No.: 18/002,586

(22) PCT Filed: Jun. 17, 2021

(86) PCT No.: PCT/SE2021/050598
§ 371 (c)(1),
(2) Date: Dec. 20, 2022

(87) PCT Pub. No.: WO2022/005363
PCT Pub. Date: Jan. 6, 2022

(65) Prior Publication Data

US 2023/0194223 A1 Jun. 22, 2023

(30) Foreign Application Priority Data

Jul. 3, 2020 (SE) ..... 2000115-2

(51) Int. Cl.
*F42B 10/14* (2006.01)

(52) U.S. Cl.
CPC ..... *F42B 10/14* (2013.01)

(58) Field of Classification Search
CPC ..... F42B 10/14
See application file for complete search history.

(56) References Cited

U.S. PATENT DOCUMENTS 3,185,097 A 5/1965 Cushing et al.
4,852,828 A 8/1989 Lamarque
(Continued)

FOREIGN PATENT DOCUMENTS

WO WO 88/05898 A1 8/1988

OTHER PUBLICATIONS

International Searching Authority, International Search Report and Written Opinion received for International Application No. PCT/SE2021/050598, dated Aug. 24, 2021, 13 pages, Swedish Patent And Registration Office, Sweden.
(Continued)

*Primary Examiner* — Valentina Xavier
(74) *Attorney, Agent, or Firm* — Alston & Bird LLP

(57) ABSTRACT

The invention relates to a wing arrangement (10) for a projectile (1). The wing arrangement (10) comprising: a wing shaft (20) extending longitudinally between a proximal end (21) and a distal end (22) along a wing shaft axis (R), the proximal end (21) being configured to be inserted into a wing shaft aperture (6) in a circumferential wall (2) of the projectile (1), the wing shaft (20) being rotatable around the wing shaft axis (R); a wing blade (30) connected to the distal end (22) of the wing shaft (20); a deployment arrangement (40) configured to control a rotational movement of the wing shaft (20) around the wing shaft axis (R), whereby the wing blade (30) is deployed from a folded state to a deployed state. The deployment arrangement (40) comprising a pre-tensioned torsion spring (41) arranged coaxially with the wing shaft (20), wherein a first end (42) of the torsion spring (41) is coupled to the wing shaft (20) and a second end (43) of the torsion spring (41) is configured to be coupled to the circumferential wall (2) of the projectile (1). The invention also relates to a method for deploying a wing blade (30), use
(Continued)

of a wing arrangement (10), a projectile (1) and a method for assembly of a wing arrangement (10).

14 Claims, 9 Drawing Sheets

(56) References Cited

U.S. PATENT DOCUMENTS

| | | | | |
|---|---|---|---|---|
| 6,168,111 | B1 | 1/2001 | Kayser et al. | |
| 8,894,004 | B1 | 11/2014 | Scott et al. | |
| 2005/0218260 | A1 | 10/2005 | Corder et al. | |
| 2006/0163423 | A1* | 7/2006 | Parine | F42B 10/14 244/3.27 |
| 2007/0125904 | A1* | 6/2007 | Janka | F42B 10/14 244/3.28 |
| 2019/0154420 | A1 | 5/2019 | Bavanari et al. | |
| 2019/0219373 | A1* | 7/2019 | Pinoteau | F42B 10/02 |

OTHER PUBLICATIONS

Swedish Patent and Registration Office, Search Report received for Application No. 2000115-2, dated Feb. 24, 2021, 3 pages, Sweden.

* cited by examiner

SECTION C - C

SECTION B - B

SECTION A - A

WING ARRANGEMENT, A PROJECTILE, A METHOD FOR DEPLOYING A WING BLADE, A USE AND A METHOD FOR ASSEMBLY

CROSS REFERENCE TO RELATED APPLICATIONS

This application is a National Stage Application, filed under 35 U.S.C. § 371, of International Application No. PCT/SE2021/050598, filed Jun. 17, 2021, which international application claims priority to and the benefit of Swedish Application No. 2000115-2, filed Jul. 3, 2020; the contents of both of which as are hereby incorporated by reference in their entireties.

BACKGROUND

Related Field

The present invention relates to a wing arrangement for a projectile. The invention further relates to a method for deploying a wing blade for a projectile by using such a wing arrangement and use of such a wing arrangement for deployment of a wing blade during launch of a projectile. The invention also relates to a projectile comprising such a wing arrangement and a method for assembly of a wing arrangement.

Description of Related Art

Projectiles often comprise wings for enhancing flight characteristics. However, during storage and at launch, the projectiles are often accommodated in narrow compartments, such as canisters and launch tubes. In order to fit the projectiles into storage compartments and launchers, the wings are folded. After a projectile have been launched, the wings of the projectile have to be rapidly unfolded and fixed, so that a steady flight may be achieved. There are many different solutions for unfolding of wings comprising deployment actuators of various configurations. However, there may still be a need for a more compact solution enabling efficient deployment of a wing blade.

One known solution for a projectile comprising foldable fins is disclosed in document U.S. Pat. No. 6,168,111 B1. The document discloses fins which are deployed upon launch and then locked in a deployed position.

BRIEF SUMMARY

An object of the present invention is to achieve an advantageous wing arrangement for a projectile.

Another object of the invention is to achieve a compact wing arrangement.

A further object of the invention is a time- and cost-efficient method for assembly of a wing arrangement.

The above mentioned objects, and other objects apparent from the following description, are achieved by:

- a wing arrangement for a projectile,
- a method for deploying a wing blade for a projectile by using such a wing arrangement,
- use of such a wing arrangement for deployment of a wing blade during launch of a projectile,
- a projectile comprising such a wing arrangement, and
- a method for assembly of a wing arrangement, as set out in the appended independent claims.

Hence, according to an aspect of the present disclosure a wing arrangement for a projectile is provided. The wing arrangement being configured to be altered between a folded state and a deployed state. The wing arrangement comprising: a wing shaft extending longitudinally between a proximal end and a distal end along a wing shaft axis, the proximal end being configured to be inserted into a wing shaft aperture in a circumferential wall of the projectile, the wing shaft being rotatable around the wing shaft axis; a wing blade connected to the distal end of the wing shaft, the wing blade being configured to be folded towards the circumferential wall of the projectile in the folded state and to extend away from the circumferential wall in the deployed state; a deployment arrangement configured to control a rotational movement of the wing shaft around the wing shaft axis, whereby the wing blade is deployed from the folded state to the deployed state. The deployment arrangement comprising a pre-tensioned torsion spring arranged coaxially with the wing shaft, wherein a first end of the torsion spring is coupled to the wing shaft and a second end of the torsion spring is configured to be coupled to the circumferential wall of the projectile.

According to another aspect of the present disclosure, a method for deploying a wing blade for a projectile by using a wing arrangement as disclosed herein is provided. The method comprising the step of: rotating the wing shaft around the wing shaft axis by release of stored spring force in the pre-tensioned torsion spring.

According to another aspect of the present disclosure, use of a wing arrangement as disclosed herein for deployment of a wing blade during launch of a projectile is provided.

According to another aspect of the present disclosure, a projectile comprising at least one wing arrangement as disclosed herein is provided.

According to another aspect of the present disclosure, a method for assembly of a wing arrangement is provided. The wing arrangement being configured to be altered between a folded state and a deployed state. The wing arrangement comprising: a wing shaft extending longitudinally between a proximal end and a distal end along a wing shaft axis, the proximal end being configured to be inserted into a wing shaft aperture in a circumferential wall of the projectile, the wing shaft being rotatable around the wing shaft axis; a wing blade connected to the distal end of the wing shaft, the wing blade being configured to be folded towards the circumferential wall of the projectile in the folded state and to extend away from the circumferential wall in the deployed state; a deployment arrangement configured to control a rotational movement of the wing shaft around the wing shaft axis, whereby the wing blade is deployed from the folded state to the deployed state. The deployment arrangement comprising a pre-tensioned torsion spring arranged coaxially with the wing shaft, wherein a first end of the torsion spring is coupled to the wing shaft and a second end of the torsion spring is coupled to the circumferential wall. The second end of the torsion spring is configured to be coupled to the circumferential wall of the projectile via an annular socket and a fastening arrangement. The fastening arrangement comprising a retaining device for retaining the torsion spring and the annular socket axially in relation to the wing shaft. The fastening arrangement further comprises a fastening device and a mating fastening part, wherein the fastening device extends into the circumferential wall and the mating fastening part is arranged in the annular socket. The wing shaft and the annular socket comprise corresponding radial holes forming a passage when aligned for an assembly pin. The method comprising the steps of: mounting the torsion spring and the annular socket around the wing shaft; fastening the retaining device at the proximal end of the wing shaft; pre-tensioning the torsion spring by aligning the radial holes in the annular socket and the wing shaft and fitting the assembly pin into the passage; mounting the wing shaft in the wing shaft aperture in the circumferential wall with the wing blade extending away from the circumferential wall of the projectile; fastening the fastening device to the mating fastening part; removing the assembly pin; folding the wing blade towards the circumferential wall; and blocking the deployment of the wing blade.

Previously known solutions for deployment of wings are often relatively space consuming. In order to manage the heavy air flows that the wing arrangement may be exposed to at launch and after launch, prior art solutions may often be relatively bulky and take up valuable space inside the projectile. Alternatively, existing solutions may be arranged in the wing blade and/or on the outside of the projectile body where the wing blade and the projectile body intersects. Such configurations may affect the aerodynamic properties of the projectile negatively and significantly increase drag. Consequently, such known solutions may not be a pertinent option for relatively small projectiles comprising thin wings, where a relative large solution for wing deployment cannot be applied.

Some of the most crucial properties of wing arrangement for deployment of wing blades are their robustness, compactness, weight and effect on aerodynamics. In the present disclosure, the wing arrangement may be arranged in association with the circumferential wall of the projectile body. Thereby, a compact wing arrangement is achieved, which saves valuable space within the projectile. A compact wing arrangement arranged essentially in the circumferential wall of the projectile may also facilitate thinner wing blades, which may improve the aerodynamic properties. A relatively small and compact wing arrangement also reduces the weight of the projectile, which is favourable. In addition, a smooth and streamlined wing arrangement may be achieved, reducing drag and further improving the aerodynamic properties of the projectile. Even though the wing arrangement as disclosed herein is compact, it is still forceful and reliable, enabling efficient deployment and enhanced stabilising effects. Thus, precise and steady flight characteristics may be achieved.

The aerodynamic properties of the projectile may be affected by the wing geometry, since the amount of lift generated by an object depends on the shape and size of the object. Commonly known wing folding solution often comprises hinge suspended wing blades, as disclosed in e.g. U.S. Pat. No. 6,168,111 B1. Such a hinge suspended wing blade, with "wrap-around fins", cannot be configured to extend that far from the projectile in the deployed state, since a longer hinge suspended wing would not fit into a storage compartment or launch tube in the folded state. The configuration of the wing arrangement according to the present disclosure allows for a relatively long wing blade, in relation to the diameter of the projectile. Thereby, the stabilising effects of the wing blade may be improved and the flight characteristics of the projectile further enhanced.

By deploying a wing blade for a projectile by using a wing arrangement as disclosure herein, an efficient and reliable deployment of the wing blade may be achieved. By the release of stored spring force, the deployment motion of the wing blade is activated. The release of stored spring force may according to an example be accomplished by merely removing any blockage impeding the unfolding of the wing blade. Such blockage may for example be the inner walls of a launch tube. When the projectile is launched and exits the launch tube, the counteracting force applied by the inner walls of the launch tube restricting the unfolding of the wing blade may be removed. Hence, the stored spring force in the pre-tensioned torsion spring may be released. The configuration of the wing arrangement may thus enable deployment of the wing blade without the need to actively initiate the actual deployment by means of a control device or human input. The deployment may instead be a direct effect of the launch of the projectile Thereby, a robust, reliable and effective deployment of the wing blade is achieved. In addition, by means of the present disclosure, the whole deployment procedure may be conducted in one efficient step. Thus, the number of possible failure points are significantly reduced.

By using a wing arrangement for deployment of a wing blade during launch of a projectile, a quick, reliable and effective deployment may be accomplished. Consequently, the stabilising effects during launch and flight of the projectile may increase. Thus, by means of the present disclosure, an advantageous projectile with improved flight characteristics may be achieved.

By means of the method for assembly of a wing arrangement, an efficient assembly of the wing arrangement may be achieved. The correct predetermined amount of pre-tensioning may be achieved with an increase quality and predictability. Due to the easy handling of the wing arrangement, the persons assembling the wing arrangement need less training and time to assemble the projectile, which further reduces the expenditure of time and costs. Also, the risk of inaccurate assembly and/or pre-tensioning may be reduced.

Further objects, advantages and novel features of the present invention will become apparent to one skilled in the art from the following details, and also by putting the invention into practice. Whereas the invention is described below, it should be noted that it is not restricted to the specific details described. Specialists having access to the teachings herein will recognise further applications, modifications and incorporations within other fields, which are within the scope of the invention.

BRIEF DESCRIPTION OF THE FIGURES

For fuller understanding of the present invention and further objects and advantages of it, the detailed description set out below should be read together with the accompanying drawings, in which the same reference notations denote similar items in the various drawings, and in which.

DETAILED DESCRIPTION OF VARIOUS EMBODIMENTS

Figure 1A:
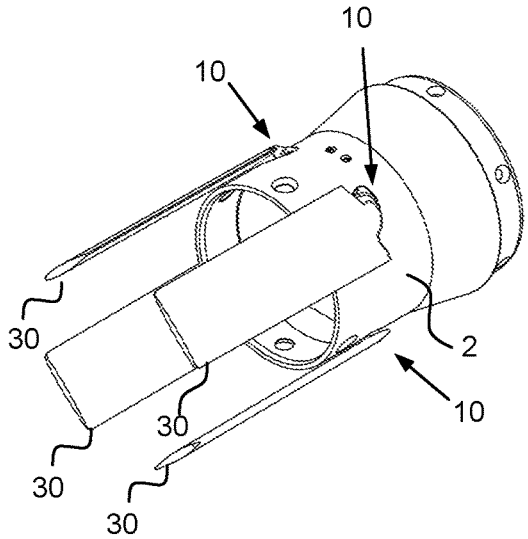
FIGS. 1*a*-1*d* schematically illustrate a wing arrangement according to an example.

The wing arrangement for a projectile will be described in further detail below. It is understood that all the various examples of the wing arrangement also applies for the method for deploying a wing blade for a projectile by using such a wing arrangement, the use of a such a wing arrangement for deployment of a wing blade during launch of a projectile, the projectile comprising such a wing arrangement and the method for assembly of a wing arrangement.

According to an aspect of the present disclosure, a wing arrangement for a projectile is provided. The wing arrangement being configured to be altered between a folded state and a deployed state. The wing arrangement comprising:

a wing shaft extending longitudinally between a proximal end and a distal end along a wing shaft axis, the proximal end being configured to be inserted into a wing shaft aperture in a circumferential wall of the projectile, the wing shaft being rotatable around the wing shaft axis; a wing blade connected to the distal end of the wing shaft, the wing blade being configured to be folded towards the circumferential wall of the projectile in the folded state and to extend away from the circumferential wall in the deployed state; a deployment arrangement configured to control a rotational movement of the wing shaft around the wing shaft axis, whereby the wing blade is deployed from the folded state to the deployed state, the deployment arrangement comprising a pre-tensioned torsion spring arranged coaxially with the wing shaft, wherein a first end of the torsion spring is coupled to the wing shaft and a second end of the torsion spring is configured to be coupled to the circumferential wall of the projectile.

The wing arrangement as disclosed herein may be used for any projectile with deployable wings, such as a missile or a grenade. A missile may often comprise deployable wings arranged at a middle portion of a missile body, and deployable steerable wings, which may also referred to as fins, arranged at the rear of the missile body. By means of steerable fins, the missile's flight trajectory may be controlled after launch. Grenades may also comprise wings. However, these wings are generally not steerable. The deployable wing blade as disclosed herein may essentially be used for stabilising the motion of the projectile. According to examples, the wing arrangement may be configured for projectiles of a length along the centre axis of less than 2 metres, or less than 1.5 metres, or less than 1.2 metres. According to a specific example, the wing arrangement may be configured for projectiles of a length along a centre axis of the projectile of about 1 metre. According to examples, the wing arrangement may be configured for projectiles with a cross-sectional diameter of less than 0.2 metre, or less than 0.15 metre, or less than 0.1 metre, or less than 0.084 metre. According to examples, the wing blade may extend more than 0.05 metre, or more than 0.07 metre, or more than 0.09 metre, away from the circumferential wall of the projectile in the deployed state.

According to an example, the wing arrangement may be configured for a projectile, which is configured to be launched by a weapon. The weapon may comprise a missile launcher, a grenade launcher or any other suitable weapons. The grenade launcher may be a portable grenade launcher.

The wing arrangement is configured to be altered between a folded state and a deployed state. Due to the two different states, a compact configuration for storage and launch may be enabled in the folded state, and a relatively large wing area may be facilitated in the deployed state.

A wing arrangement comprising a wing shaft being arranged with its proximal end inserted into a wing shaft aperture in the circumferential wall of the projectile and the distal end of the wing shaft connected to the wing blade, enables the use of a wing blade of increased length, compared to other solutions. According to an example, the length of the wing blade along a wing blade axis may be longer than cross-sectional diameter of the projectile. This means that the extension of the wing blade along the wing blade axis from the circumferential wall of the projectile in the deployed state may be longer that the radial width of the projectile. According to a specific example, the length of the wing blade along the wing blade axis may be about 0.1 metres and the cross-sectional diameter of the projectile may be less than 0.084 metres. Thus, the present disclosure may enable a significant increase of the wing blade area in relation to the cross-sectional area of the projectile. Still, in the folded state, the wing blade may be neatly folded close to the circumferential wall of the projectile, without occupying valuable space within the projectile or in the launch tube.

By means of the wing shaft being rotatable around the wing shaft axis, the rotational movement of the wing blade between the folded state and the deployed state may be enabled. By means of the deployment arrangement comprising a pre-tensioned torsion spring, the rotational movement of the wing blade may be efficiently powered and controlled. By arranging the pre-tensioned torsion spring coaxially with the wing shaft, wherein a first end of the torsion spring is coupled to the wing shaft and a second end of the torsion spring is configured to be coupled to the circumferential wall of the projectile, the wing shaft may be rotated in relation to the circumferential wall when the pre-tensioned spring force is released. The wing blade, which is connected to the wing shaft, may thus be deployed when the wing shaft rotates. Thereby, an effective, compact and reliable deployment solution may be achieved. In addition, the deployment arrangement as disclosed herein may be favourable since it is relatively unaffected by temperature changes, moisture, vibrations and other factors which the projectile may be exposed to while being transported and stored prior to launch, and also exposed to during launch.

Thus, by means of the wing arrangement comprising a wing shaft, a wing blade and a deployment arrangement as disclosed herein, an advantageous, reliable and compact wing arrangement may be achieved, which enables a relative large wing size in relation to the size of the projectile, and thus increases the stabilising effects without reducing the cargo space within the projectile or impairing the aerodynamic properties.

During assembly of the wing arrangement, the wing shaft, the wing blade and the deployment arrangement may be fitted together. The torsion spring may pre-tensioned. The pre-tension of the torsion spring may be accomplished by twisting, since torsion springs may store mechanical energy as it is twisted and may thus exert force in the opposite direction corresponding to the pre-tensioning twist of the torsion spring. According to an example, the pre-tensioning of the torsion spring may be accomplished in two steps, which may be referred to as a first pre-tensioning and a second pre-tensioning. The torsion spring may during a first pre-tensioning be pre-tensioned to a predetermined level. The predetermined level, or amount, of the first pre-tensioning may be mechanically controlled by means of fixed assembly points. This means that the pre-tensioning may be controlled by the geometrical configuration of the wing arrangement. Alternatively, the pre-tensioning of the torsion spring may be controlled on the basis of measured values obtained from measuring equipment used during assembly. Next, the wing shaft may be mounted in the wing shaft aperture in the circumferential wall with the wing blade extending away from the circumferential wall of the projectile, i.e. in the deployed state. Then, by folding the wing blade towards the circumferential wall, the torsion spring may be further pre-tensioned. This step may thus be referred to as the second pre-tensioning. Subsequently, the deployment of the wing blade may be blocked, in order to counteract that the wing blade may flip out, due to the stored spring tension. The blockage of the wing blade may be accomplished by means of any suitable type of blocking device. According to examples, the blockage device may comprise a temporary external blocking device, such as a cable tie, a strap or an open cylinder, which may be arranged around the projectile so that the deployment of the wing blade may be restricted during e.g. storage and transportation of the projectile. According to another example, the wing arrangement may comprise a releasable blocking device. The releasable blocking device may for example comprise a blocking wedge or a blocking pin. The releasable blocking device may be released manually, e.g. when the projectile is positioned in a launch tube counteracting the deployment of the wing blades. Alternatively, the release of the releasable blocking device may be actuated by a signal or a sensor at launch. When having a releasable blocking device actuated by a signal or sensor, the size of the projectile and the launch tube may not necessarily have to match. Thus, a relative small projectile may be launched from a relatively wide launch tube, since the deployment of the wing blades may be blocked by the releasable blocking device until the projectile has been launched and exits the launch tube and the blocking device is released on the basis of the signal or sensor. For example, the sensor may indicate when the projectile leaves the launch tube. Alternatively, the blocking device may be released after a predetermined time delay from the initiation of launch. According to other examples, the blocking device may comprise a canister for storage of the projectile, or a launch tube, from which the projectile may be launched, or an adapter for a launch tube. An adapter for a launch tube may for example comprise an adapter tube which may be inserted into the launch tube, in order to adapt the size or inner surface of the launch tube to the applied type of projectile.

Prior to launch, the projectile comprising the wing arrangement may be placed in a launch tube, or similar device, with the wing blade in the folded position. Any temporary and/or releasable blocking devices which have to be removed, or released manually, such as cable ties, straps, cotter pins or locking wedges, may be removed or released before launch. When the projectile is arranged in the launch tube, the inner walls of the launch tube may act as a blocking device and counteract the deployment of the wing blades. However, when the projectile is launched and exits the launch tube, the counteracting force applied by the inner walls of the launch tube restricting the rotational movement is removed. Hence, the stored spring force in the pre-tensioned torsion spring is released. The released spring force forces the wing shaft to rotate around the wing shaft axis and the wing blade is deployed from the folded state to the deployed state. The deployment may further be assisted and/or accelerated by fluid resistance, which is the force acting opposite the relative motion of the projectile as it passes through ambient fluid, such as air or water. The wing blade in the deployed state may provide favourable stabilising effects and facilitate a steady flight, which in turn may increase the target accuracy.

According to an example, the wing arrangement may further comprise a locking arrangement for retaining the wing blade in the deployed state. In certain cases, the spring force in the torsion spring may not be sufficient to hold the wing blade steady in a deployed state, when exposed to air resistance. Increasing the strength of the torsion spring may not be a pertinent option, since a larger and more forceful torsion spring may take up to much space for a relatively small projectile. A locking arrangement may then be useful for maintaining the wing blade in the deployed state. The locking arrangement may also increase the stability of the wing blades, compared to holding the wing blade in the deployed state merely by spring force. This may in turn further increase the stabilising effect of the projectile in motion. According to examples, the locking arrangement may comprising locking wedges and corresponding recesses, locking pins and corresponding slots or any other suitable locking arrangement holding the wing blade still in a deployed position. Such wedges and/or pins and corresponding recess and/or slots may be arranged in association with the wing shaft and/or the circumferential wall of the projectile. After the projectile has been launched and the wing shaft has been rotated to the deployed state by means of the stored spring force, the locking arrangement may be activated by means of release of e.g. spring force, pneumatic pressure or hydraulic fluid pressure. Alternatively, the locking arrangement may comprise magnets, e.g. a magnetic lock.

According to an example, the locking arrangement may comprise at least one spring biased locking pin and at least one corresponding locking slot, wherein the at least one locking slot is arranged in the wing shaft. The at least one spring biased locking pin may be aligned with the corresponding locking slot in the deployed state. The at least one spring biased locking pin may thus automatically flip into a locking position, when the wing blade reaches a deployed state. By means of arranging the at least one locking slot in the wing shaft, a compact and reliable solution for retaining the wing blade in the deployed state may be achieved. According to an example, the longitudinal extension of the at least one spring biased locking pin may be arranged in parallel with the centre axis of the projectile. The at least one spring biased locking pin may be configured to be arranged in connection to the circumferential wall of the projectile. According to an example, the at least one spring biased locking pin may be configured to be arranged essentially within the circumferential wall. Thus, a reliable and compact locking solution may be achieved, which do occupy valuable space within the projectile. According to an example, the at least one spring biased locking pin and the at least one corresponding locking slot has a conical shape.

According to an example, the locking arrangement may further comprise a spring housing, wherein the spring housing is configured to accommodate the at least one spring biased locking pin. The spring housing may facilitate the assembly and pre-tensioning of the spring biased locking pin. According to an example, the locking arrangement may be reset from the locked position by retraction of the spring biased locking pin via the spring housing. Thus, the spring housing may comprise a reset opening where a tool may be introduced in order to pull the spring biased locking pin back when the wing blade is in the deployed state and the locking arrangement is in the locked position, and thereby enable folding of the wing blade.

According to an example, the torsion spring may be a helical torsion spring. According to an example, the torsion spring may be arranged around the periphery of a portion of the wing shaft. A helical torsion spring may provide a compact and forceful solution for driving the rotational movement of the wing shaft, and deploying the wing blade. For a specific example, the diameter of the helical torsion spring may be about 6 millimetre and the wire thickness of around 1 millimetre for a projectile of a length of about 1 metre and wing blades of a length along the wing axis of about 0.1 metre. Thus, the helical torsion spring may be relatively small, enabling a very compact solution for deployment of the wing blades. However, the dimensions of the helical torsion spring may be scalable and adapted to the current size and configuration of the projectile and/or wing blade. According to an example, the torsion spring may be a clock spring. A clock spring may be a form of helical torsion spring where the coils are arranged around each other instead of piled up. Alternatively, the torsion spring may comprise a torsion bar.

According to an example, the second end of the torsion spring may be connected to circumferential wall of the projectile. The second end of the torsion spring may be connected to the circumferential wall by means of a fastener, such as a screw. However, assembly and pre-tensioning of a torsion spring directly connected to the circumferential wall may be difficult and time consuming. Thus, according to an example, the second end of the torsion spring may be configured to be coupled to the circumferential wall via an annular socket and a fastening arrangement. The annular socket may be configured to be arranged around the periphery of a portion of the wing shaft. By means of the annular socket, the assembly of the wing arrangement may be less complicated and time consuming, compared to solutions where the second end of the torsion spring may e.g. be directly connected to circumferential wall of the projectile. In addition, the outer radial surface of the annular socket may act as a first guide surface. The first guide surface may be favourable for load bearing and control of the rotational movement around the wing shaft axis. An outer radial surface part of the distal end of the wing shaft may in a corresponding way act as a second guide surface. By means of having the first and second guide surfaces relatively far apart, a stable and secure mounting and rotation of the wing shaft in relation to the circumferential wall may be achieved.

Thus, according to examples, the annular socket may comprise a first guide surface and the wing shaft may comprise a second guide surface. The second guide surface may abut the wing shaft aperture in the circumferential wall. The first and second guide surfaces may be axially symmetric around the wing shaft axis. The first and second guide surfaces may be arranged in parallel with the wing shaft axis.

According to an example, the wing arrangement may comprise a surface coating. According to examples, the wing shaft and/or the annular socket and/or the locking pin may comprise a surface coating. A surface treatment such as a coating may reduce the friction, which in turn may facilitate the rotational movement from the folded state to the deployed state.

According to an example, the fastening arrangement may comprise a retaining device for retaining the torsion spring and the annular socket axially in relation to the wing shaft. According to examples, the retaining device may comprise a retaining ring, a locking screw, a nut or any other suitable device. According to an example, the retaining device is configured to be arranged at the proximal end of the wing shaft.

According to an example, the fastening arrangement may further comprise a fastening device and a mating fastening part, wherein the fastening device extends into the circumferential wall and the mating fastening part is arranged in the annular socket. By means of the fastening device and the mating fastening part arranged in the annular socket, the wing arrangement may be fastened in relation to the circumferential wall of the projectile in an effective and time-efficient way.

According to an example, the fastening device may comprise a screw, a spring pin or any other suitable fastener. According to an example, the mating fastening part in the annular socket may comprise a recess, a screw threaded opening or any other suitable mating fastening part cooperating with the fastening device. The fastening device may be accessible from the outside of the circumferential wall. Thereby, a user-friendly assembly of the wing arrangement may be achieved.

According to an example, the wing shaft and the annular socket comprise corresponding radial holes forming a passage when aligned, whereby the torsion spring is pre-tensioned by fitting an assembly pin into the passage during assembly of the wing arrangement. The pre-tensioning obtained by means of the assembly pin has previously been mentioned as the first pre-tensioning. By means of the passage and the assembly pin, a predetermined and accurate pre-tensioning of the torsion spring may be achieved, without the need for measuring and/or testing the pre-tension of the torsion spring at assembly.

When the wing arrangement reaches the deployed state, there may be a risk that the wing arrangement bounces back at the impact of reaching an end position. The pre-tensioning obtained by means of the passage and the assembly pin may correspond to the remaining spring force in the torsion spring when the wing arrangement is in deployed state. The first pre-tensioning may thus counteract any bouncing back effect. This may also be beneficial when the wing arrangement comprises a locking arrangement. If the wing arrangement would flip out and bounce back faster than the spring biased locking pin is able to move, the first pre-tensioning may counteract the bouncing and ensure that the locking slot may be aligned with its mating spring biased locking pin. Thus, the torsion spring may exert spring force over a larger span than the wing shaft is allowed to rotate, in order to have a margin for tolerances and deviations. The main pre-tensioning required for the actually deploying movement of the wing arrangement at launch, which previously has been referred to as the second pre-tensioning, is obtained when the wing blades are folded after all of the wing arrangement components have been mounted.

The assembly pin is a temporary device which may only be used during assembly. The wing shaft may be disabled from rotating as long as the assembly pin is arranged in the passage. Thus, the assembly pin may be removed after the wing shaft has been mounted in the wing shaft aperture in the circumferential wall of the projectile in the deployed state, in order to enable folding of the wing blade.

According to an example, the wing shaft comprise at least one first mounting hole configured to receive the first end of the torsion spring. By means of connecting the first end of the torsion spring to the wing shaft by means of a fixed mounting hole, the assembly and pre-tensioning of the torsion spring may be facilitated. Thus, the assembly procedure may be less cumbersome and time-consuming compared to fastening the torsion spring by means of a screw or similar fasteners. According to an example, the at least one first mounting hole extends in parallel with the wing shaft axis. Thus, the at least one first mounting hole extends along an axial direction of the wing shaft and may thus be referred to the at least one first axial mounting hole. The at least one first mounting hole may extend into a first mounting surface of the wing shaft. The first mounting surface may extend axially symmetric around the wing shaft axis and in a plane perpendicular to the wing shaft axis.

According to an example, the annular socket comprises at least one second mounting hole configured to receive the second end of the torsion spring. The at least one second mounting hole may have corresponding benefits as the at least one first mounting hole. According to an example, the at least one second mounting hole may extend in an axial direction of the annular socket and may thus be referred to the at least one second axial mounting hole. According to an example, the at least one second mounting hole may extend in parallel with the wing shaft axis when the annular socket is arranged on the wing shaft.

According to an example, the wing blade is configured to, in the folded state, extend in a direction towards a front end of the projectile. By having the wing blade pointing in the direction of motion during flight in the folded state, the air resistance may assist in the deployment of the wing blades. The first deploying action may be powered by the release of stored spring force. When the wing blades have started to unfold, the ambient air flowing past the projectile may further force the wing blade to a fully deployed state.

According to an example, the wing blade may extend longitudinally along a wing blade axis, wherein the wing blade axis is arranged at a first angle in relation to the wing shaft axis. According to an example, the wing blade axis may be inclined with a first angle in relation to the wing shaft axis. According to an example, the first angle may be an obtuse angle. Thus, the first angle may be greater than 90° and less than 180°. According to examples, the first angle may be between 95° to 170°, or 100° to 160°, or 105° to 150°, or 110° to 140°. The first angle may affect the position of the wing blade in the folded state and the deployed state. Thus, the first angle may enable that the wing blade may be folded towards the circumferential wall in the folded state while extending away from the circumferential wall in the deployed state.

According to an example, the wing blade axis of the wing blade in the folded state may be arranged in parallel with a centre axis of the projectile. According to an example, the wing blade axis of the wing blade in the deployed state may extend in a radial direction from the centre axis of the projectile. According to an example, the wing blade axis of the wing blade in the deployed state may be arranged in a radial direction from the centre axis and at a second angle in relation to the centre axis, leaning towards a rear end of the projectile. Thus, the second angle may be an acute angle, i.e. between 0° and 90°. According to examples, the second angle may be between 5° to 90°, or 10° to 75°, or 15° to 50°. According to a specific example, the second angle may be about 20°. Wing blades leaning towards the rear end may increase the aerodynamic characteristics and enhance the stabilising effects. According to an example, the second angle may be variable and adjusted to the current application. According to an example, the wing blade may be exchangeable. Thus, the wing blade may be configured to be removably attached to the distal end of the wing shaft.

According to examples, the wing shaft and wing blade may comprise aluminium and/or titanium and/or magnesium and/or composite. The wing shaft and the wing blade may consist of one monolithic wing component. According to a specific example, the monolithic wing component may consist of aluminium. The torsion spring, the retaining ring and the assembly pin may comprise steel. Other alternative materials may be e.g. titanium and/or bronze.

According to an example, the locking arrangement may be configured to be arranged at least partly within the circumferential wall of the projectile. According to an example, the deployment arrangement may be configured to be arranged at least partly within the circumferential wall of the projectile. This means that the deployment arrangement and/or the locking arrangement may at least partly be surrounded by the circumferential wall. Thereby, a compact and aerodynamic wing arrangement may be achieved.

According to an aspect of the disclosure, a method for deploying a wing blade for a projectile by using a wing arrangement as disclosed herein is provided. The method comprising the step of: rotating the wing shaft around the wing shaft axis by release of stored spring force in the pre-tensioned torsion spring. Thus, by the release of stored spring force, the deployment motion of the wing blade may be activated.

The torsion spring may be pre-tensioned by twisting. When the stored mechanical energy in the torsion spring is released, the torsion spring may twist back, in an opposite direction to the pre-tensioning. Since the first end of the torsion spring is coupled to the wing shaft and the second end of the torsion spring is configured to be coupled to the circumferential wall of the projectile, the release of stored spring force may force the wing shaft to rotate and thereby unfold the wing blade, which is connected to the wing shaft. According to an example, the stored spring force in the pre-tensioned torsion spring may be released after launch of the projectile.

The release of stored spring force may be accomplished by removal of any blockage impeding the unfolding of the wing blade. When the projectile is arranged in e.g. a lunch tube, the inner walls of the launch tube may act as a blocking device and counteract the deployment of the wing blades. However, when the projectile is launched and exits the launch tube, the counteracting force applied by the inner walls of the launch tube restricting the rotational movement may be removed. Alternatively, the wing arrangement may comprise a releasable blocking device wherein the release of the releasable blocking device may be actuated by a signal or a sensor at launch. For example, the sensor may indicate when the projectile leaves the launch tube and a signal may actuate the release of stored spring force. Alternatively, the blocking device may be released after a predetermined time delay from the initiation of launch.

The release of the spring force may force the wing shaft to rotate around the wing shaft axis whereby the wing blade may be deployed from the folded state to the deployed state. The deployment may further be assisted and/or accelerated by fluid resistance. The method for deploying a wing blade as disclosed herein may be favourable due to its simplicity and failsafe execution. By means of the method, a quick and responsive deployment may be achieved, enabling stabilising effects instantaneously after launch, thereby facilitate a steady flight, which in turn may increase the target accuracy.

According to an example, the method may further comprise the step of: prior to rotating, unblocking rotational movement of the wing blades and/or the wing shaft. The unblocking of rotation movement may refer to removal or release of any blocking device, as previously disclosed herein.

According to an example, the method may further comprise the step of: locking the wing arrangement in the deployed state. According to an example, the wing arrangement may be locked in the deployed state by means of a locking arrangement as previously described herein, or any other suitable locking device.

According to an aspect of the present disclosure, use of a wing arrangement for deployment of a wing blade during launch of a projectile is provided. By using a wing arrangement for deployment of a wing blade during launch of a projectile, a quick, reliable and effective deployment may be accomplished. Consequently, the stabilising effects during launch and flight of the projectile may increase.

According to an aspect of the present disclosure, a projectile comprising at least one wing arrangement as disclosed herein is provided. According to an example, the projectile may comprise any projectile with deployable wings, such as a missile or a grenade. Thereby, a projectile with improved flight characteristics may be achieved.

According to an example, the projectile comprises at least four wing arrangements, wherein the wing arrangements may be arranged pairwise on opposite sides of the projectile. This means that two adjacent wing arrangements may be arranged with their proximal ends of their wing shafts pointing towards each other. Arranging the wing arrangements pairwise may save valuable space within the projectile. According to an example, the projectile may comprise four wing arrangements, wherein the wing blades may be arranged in a cross configuration or a plus configuration in the deployed state.

According to an aspect of the present disclosure, a method for assembly of a wing arrangement is provided. The wing arrangement being configured to be altered between a folded state and a deployed state. The wing arrangement comprising: a wing shaft extending longitudinally between a proximal end and a distal end along a wing shaft axis, the proximal end being configured to be inserted into a wing shaft aperture in a circumferential wall of the projectile, the wing shaft being rotatable around the wing shaft axis; a wing blade connected to the distal end of the wing shaft, the wing blade being configured to be folded towards the circumferential wall of the projectile in the folded state and to extend away from the circumferential wall in the deployed state; a deployment arrangement configured to control a rotational movement of the wing shaft around the wing shaft axis, whereby the wing blade is deployed from the folded state to the deployed state, the deployment arrangement comprising a pre-tensioned torsion spring arranged coaxially with the wing shaft, wherein a first end of the torsion spring is coupled to the wing shaft and a second end of the torsion spring is coupled to the circumferential wall, wherein the second end of the torsion spring is configured to be coupled to the circumferential wall of the projectile via an annular socket and a fastening arrangement, the fastening arrangement comprising a retaining device for retaining the torsion spring and the annular socket axially in relation to the wing shaft, wherein the fastening arrangement further comprises a fastening device and a mating fastening part, wherein the fastening device extends into the circumferential wall and the mating fastening part is arranged in the annular socket, the wing shaft and the annular socket comprise corresponding radial holes forming a passage when aligned for an assembly pin. These features have previously been described herein. The method for assembly of the wing arrangement comprising the steps of: mounting the torsion spring and the annular socket around the wing shaft; fastening the retaining device at the proximal end of the wing shaft; pre-tensioning the torsion spring by aligning the radial holes in the annular socket and the wing shaft and fitting the assembly pin into the passage; mounting the wing shaft in the wing shaft aperture in the circumferential wall with the wing blade extending away from the circumferential wall of the projectile; fastening the fastening device to the mating fastening part; removing the assembly pin; folding the wing blade towards the circumferential wall; and blocking the deployment of the wing blade. By means of the method for assembly, a time- and cost-efficient assembly of a wing arrangement may be achieved. Due to the use of the assembly pin, correct pre-tensioning may be achieved with an increase quality and predictability.

According to an example, the wing arrangement may further comprises a locking arrangement for retaining the wing blade in the deployed state, wherein the locking arrangement comprises at least one spring biased locking pin and at least one corresponding locking slot, wherein the at least one locking slot is arranged in the wing shaft. The method may further comprise the step of: mounting the at least one spring biased locking pin in relation to the circumferential wall. The locking arrangement may be the locking arrangement previously described herein. According to an example, the at least one spring biased locking pin may be accommodated in a spring housing. According to an example, the at least one spring biased locking pin may be mounted in relation to the circumferential wall by fastening the spring housing to the circumferential wall.

The present disclosure will now be further illustrated with reference to the appended figures, wherein for the sake of clarity and understanding of the disclosure some details of no importance are deleted from the figures. Moreover, the figures shall not be considered drawn to scale as some features may be exaggerated in order to more clearly illustrate the invention.

Figure 1B:
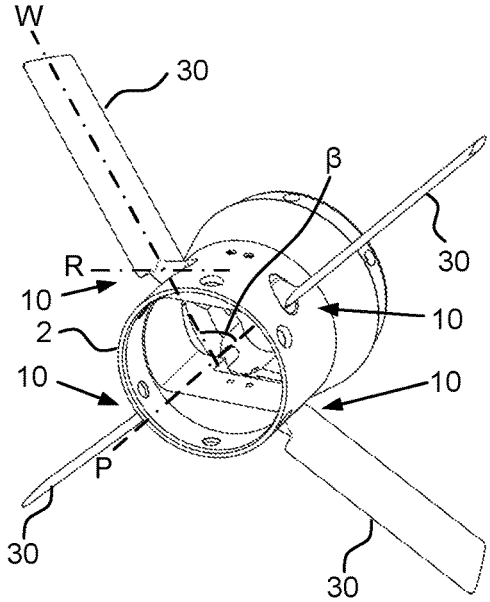
Figure 1C:
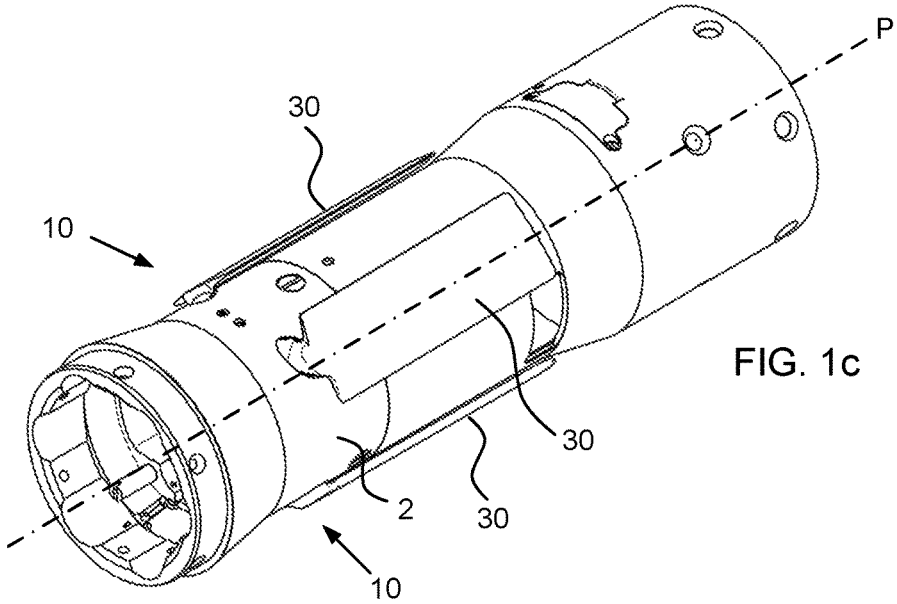
Figure 1D:
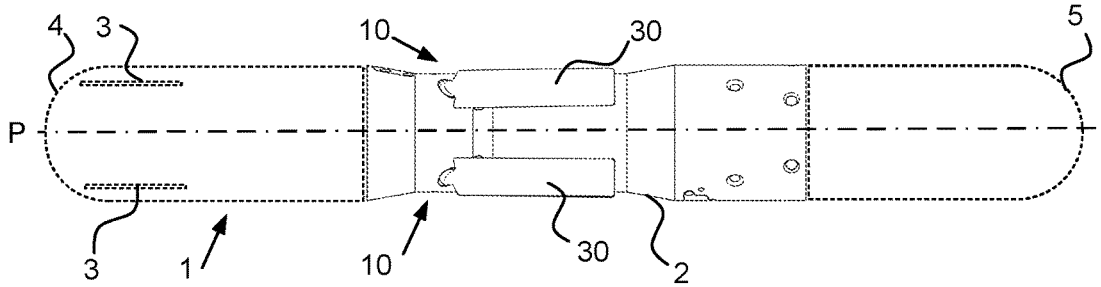

FIGS. 1*a*-1*d* schematically illustrate a wing arrangement 10 according to an example of the present disclosure. The wing arrangement 10 may be used for deployment of a wing blade 30 during launch of a projectile 1. FIGS. 1*a*-1*c* show perspective views of wing arrangements 10 arranged in association with a circumferential wall 2 of a middle portion of a projectile 1. FIG. 1*d* schematically illustrates a side view of a projectile 1 comprising at least one wing arrangement 10. The wing arrangement 10 will be further described in relation to FIGS. 2, 3, 4*a*-4*b*, 5*a*-5*b*, 6*a*-6*b*, 7*a*-7*b*, 8*a*-8*f*, 9*a*-9*b* and 10.

FIGS. 1*a*-1*d* shows wing arrangements 10 for a projectile 1. The projectile 1 shown in the figures comprises four wing arrangements. The wing arrangements 10 being configured to be altered between a folded state and a deployed state. In FIGS. 1*a*, 1*c* and 1*d*, the wing arrangements 10 are shown in the folded state. In FIG. 1*b*, the wing arrangements 10 are shown in the deployed state. Each wing arrangement 10 comprising: a wing shaft 20 extending longitudinally between a proximal end 21 and a distal end 22 along a wing shaft axis R, the proximal end 21 being configured to be inserted into a wing shaft aperture 6 in a circumferential wall 2 of the projectile 1, the wing shaft 20 being rotatable around the wing shaft axis R; a wing blade 30 connected to the distal end 22 of the wing shaft 20, the wing blade 30 being configured to be folded towards the circumferential wall 2 of the projectile 1 in the folded state and to extend away from the circumferential wall 2 in the deployed state; a deployment arrangement 40 configured to control a rotational movement of the wing shaft 20 around the wing shaft axis R, whereby the wing blade 30 is deployed from the folded state to the deployed state, the deployment arrangement 40 comprising a pre-tensioned torsion spring 41 arranged coaxially with the wing shaft 20, wherein a first end 42 of the torsion spring 41 is coupled to the wing shaft 20 and a second end 43 of the torsion spring 41 is configured to be coupled to the circumferential wall 2 of the projectile 1.

The wing arrangement 10 may be used for any projectile with deployable wings, such as a missile or a grenade. A missile may often comprise deployable wing arranged at a middle portion of the projectile 1, and deployable steerable wings 3, which may also referred to as fins, arranged in association with the rear end 4 of the projectile 1, as schematically illustrated in FIG. 1*d*.

According to examples, the wing arrangement 10 may be configured for projectiles of a length along the centre axis P of less than 2 metres, or less than 1.5 metres, or less than 1.2 metres. According to a specific example, the wing arrangement 10 may be configured for projectiles of a length along a centre axis P of the projectile of about 1 metre. According to examples, the wing arrangement 10 may be configured for projectiles 1 with a cross-sectional diameter of less than 0.2 metre, or less than 0.15 metre, or less than 0.1 metre, or less than 0.084 metre. According to examples, the wing blade 30 may extend more than 0.05 metre, or more than 0.07 metre, or more than 0.09 metre, away from the circumferential wall 2 of the projectile 1 in the deployed state.

According to an example, the length of the wing blade 30 along a wing blade axis W may be longer than cross-sectional diameter of the projectile 1. According to a specific example, the length of the wing blade 30 along the wing blade axis W may be about 0.1 metres and the cross-sectional diameter of the projectile 1 may be less than 0.084 metres.

During assembly of the wing arrangement 10, the wing shaft 20, the wing blade 30 and the deployment arrangement 40 may be fitted together. The torsion spring 41 may pre-tensioned. According to an example, the pre-tensioning of the torsion spring 41 may be accomplished in two steps, which may be referred to as a first pre-tensioning and a second pre-tensioning. The torsion spring 41 may during the first pre-tensioning be pre-tensioned to a predetermined level. The predetermined level, or amount, of the first pre-tensioning may be mechanically controlled by means of fixed assembly points. This means that the pre-tensioning may be controlled by the geometrical configuration of the wing arrangement 10. Alternatively, the pre-tensioning of the torsion spring 41 may be controlled on the basis of measured values obtained from measuring equipment used during assembly. Next, the wing shaft 20 may be mounted in the wing shaft aperture 6 in the circumferential wall 2 with the wing blade 30 extending away from the circumferential wall of the projectile 1, i.e. in the deployed state. Then, by folding the wing blade 30 towards the circumferential wall 2, the torsion spring 41 may be further pre-tensioned. This step may thus be referred to as the second pre-tensioning. Subsequently, the deployment of the wing blade 30 may be blocked, in order to counteract that the wing blade 30 may flip out, due to the stored spring tension. The blockage of the wing blade 30 may be accomplished by means of any suitable type of blocking device. According to examples, the blockage device (not shown in the figures) may comprise a temporary external blocking device, such as a cable tie, a strap or an open cylinder, which may be arranged around the projectile 1 so that the deployment of the wing blade 30 may be restricted during e.g. storage and transportation of the projectile 1. According to another example, the wing arrangement 10 may comprise a releasable blocking device. The releasable blocking device may for example comprise a blocking wedge or a blocking pin. The releasable blocking device may be released manually, e.g. when the projectile is positioned in a launch tube counteracting the deployment of the wing blades. Alternatively, the release of the releasable blocking device may be actuated by a signal or a sensor at launch.

Prior to launch, the projectile 1 comprising the wing arrangement 10 may be placed in a launch tube, or similar device, with the wing blade 30 in the folded position. Any temporary and/or releasable blocking devices which have to be removed, or released manually, such as cable ties, straps, cotter pins or locking wedges, may be removed or released before launch. When the projectile 1 is arranged in the launch tube, the inner walls of the launch tube may act as a blocking device and counteract the deployment of the wing blades 30. When the projectile 1 is launched and exits the launch tube, the counteracting force applied by the inner walls of the launch tube restricting the rotational movement is removed. Hence, the stored spring force in the pre-tensioned torsion spring 41 may be released. The released spring force forces the wing shaft 20 to rotate around the wing shaft axis W and the wing blade 30 may be deployed from the folded state to the deployed state. The deployment may further be assisted and/or accelerated by fluid resistance. The wing blade 30 in the deployed state may provide favourable stabilising effects and facilitate a steady flight, which in turn may increase the target accuracy.

As illustrated in FIG. 1*d*, the wing blade 30 may be configured to, in the folded state, extend in a direction towards a front end 5 of the projectile 1.

Figure 2:
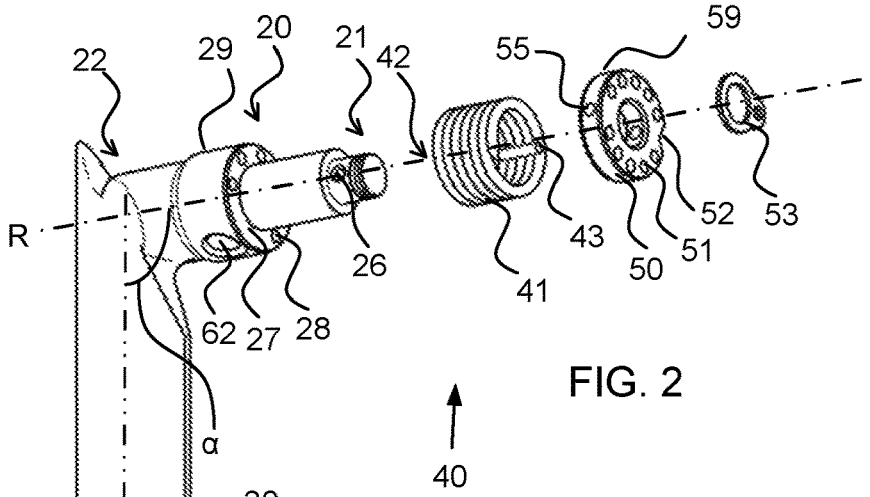
FIG. 2, schematically illustrates details of a wing arrangement according to an example.
Figure 3:
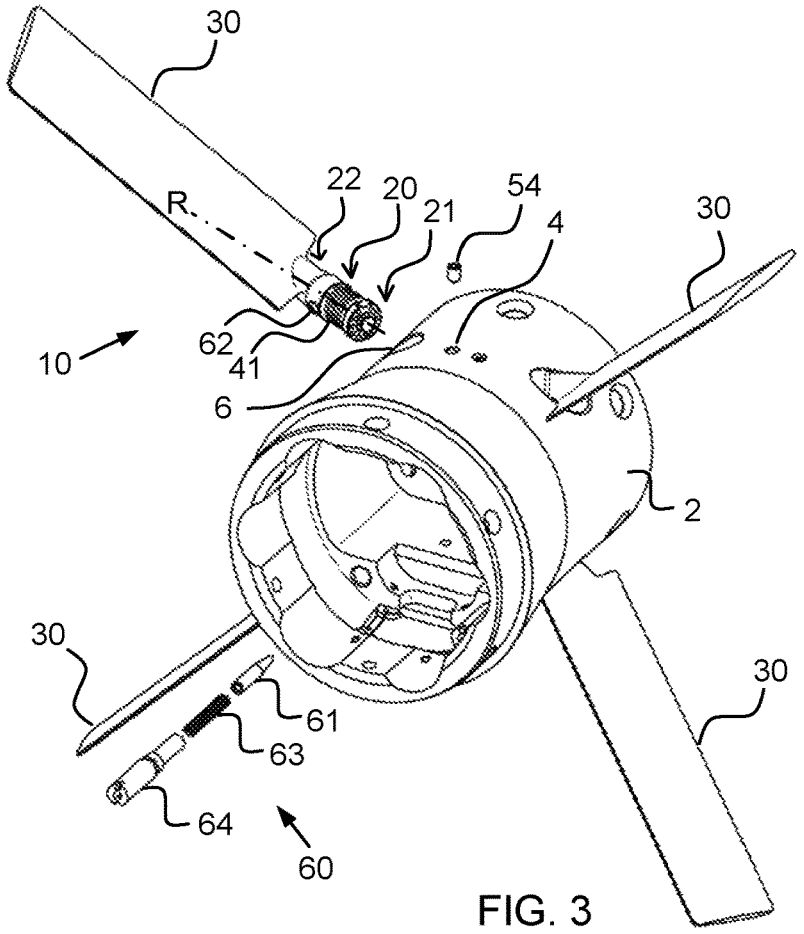
FIG. 3, schematically illustrates details of a wing arrangement according to an example.

FIG. 2 illustrates details of a wing arrangement 10 according to an example of the present disclosure. The wing arrangement 10 in FIG. 2 may be configured as disclosed in FIGS. 1*a*-1*d*. FIG. 3 schematically illustrates a perspective view of details of a wing arrangement 10 in the deployed state. The wing arrangement 10 in FIG. 3 may be configured as disclosed in FIGS. 1*a*-1*d* and 2.

According to the example shown in FIG. 3, the wing arrangement 10 may comprise a locking arrangement 60 for retaining the wing blade 30 in the deployed state. The locking arrangement 60 may comprise at least one spring biased locking pin 61, 63 and at least one corresponding locking slot 62, wherein the at least one locking slot 62 may be arranged in the wing shaft 20 (see FIG. 2). The at least one spring biased locking pin 61, 63 may be aligned with the corresponding locking slot 62 in the deployed state. The at least one spring biased locking pin 61, 63 may thus automatically flip into a locking position, when the wing blade 30 reaches a deployed state. According to an example, the longitudinal extension of the at least one spring biased locking pin 61, 63 may be arranged in parallel with the centre axis P of the projectile 1. The at least one spring biased locking pin 61, 63 may be arranged in connection to the circumferential wall 2 of the projectile 1. According to an example, the at least one spring biased locking pin 61, 63 may be arranged essentially within the circumferential wall 2. As illustrated in FIG. 3, the spring biased locking pin 61, 63 may comprise a locking pin 61 and a locking spring 63.

Figure 4A:
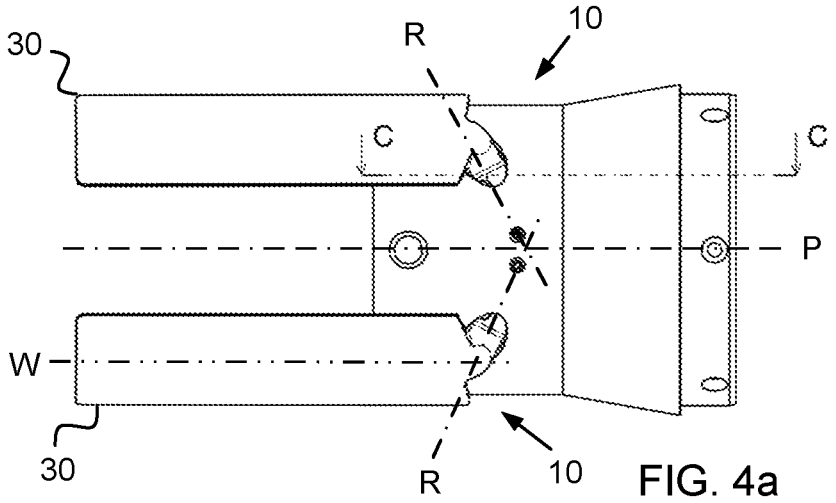
FIGS. 4*a*-4*b*, schematically illustrate details of a wing arrangement according to an example.
Figure 4B:
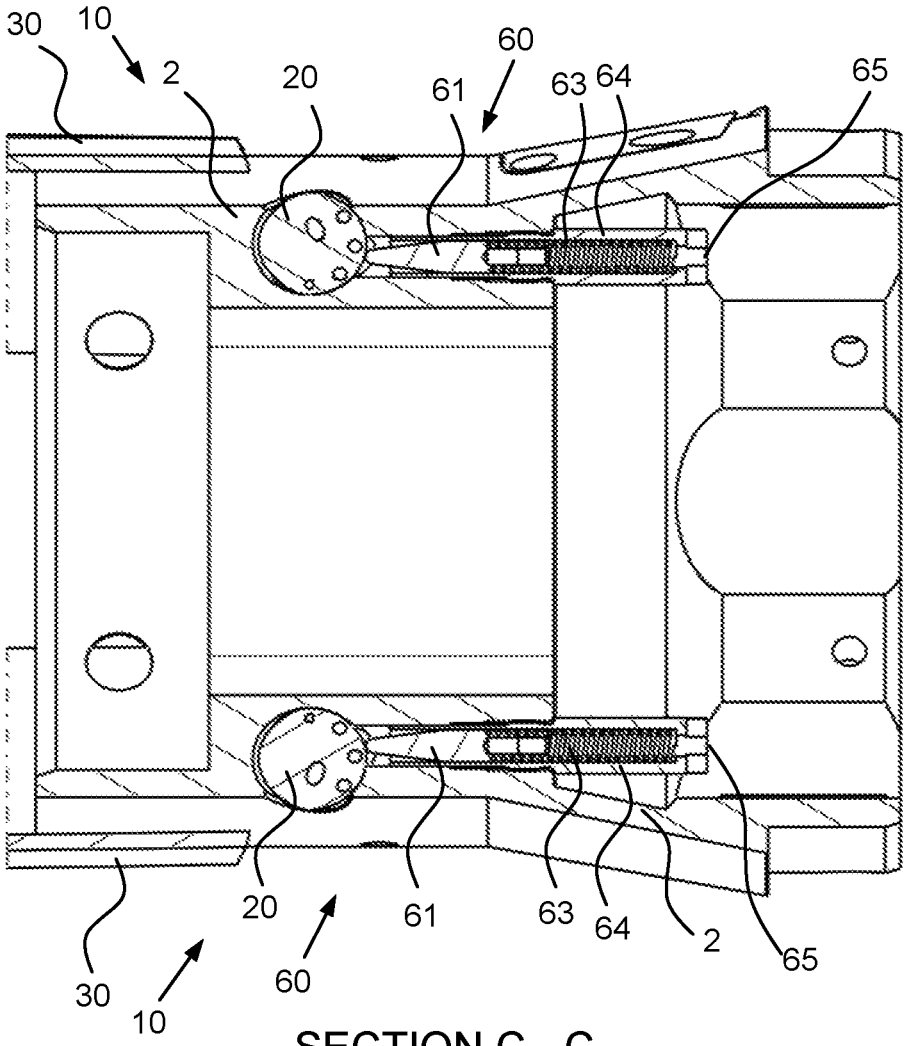

FIGS. 4*a*-4*b*, 5*a*-5*b* and 6*a*-6*b* schematically illustrates a wing arrangement 10 according to an example of the present disclosure. The wing arrangement 10 may be configured as disclosed in FIGS. 1*a*-1*d*, 2 and 3. FIG. 4*b* shows a cross sectional view through section C-C, as illustrated in FIG. 4*a*.

Figure 5A:
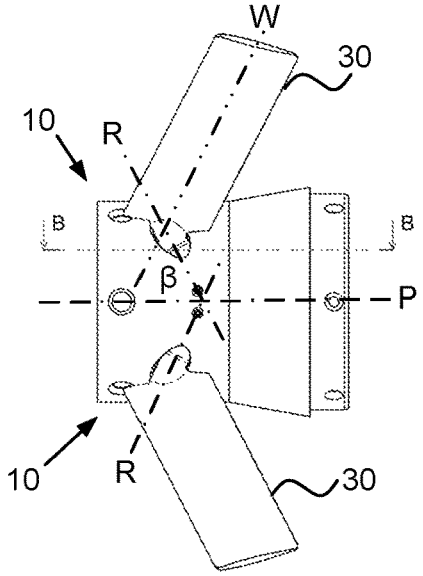
FIGS. 5*a*-5*b* schematically illustrate details of a wing arrangement according to an example.
Figure 5B:
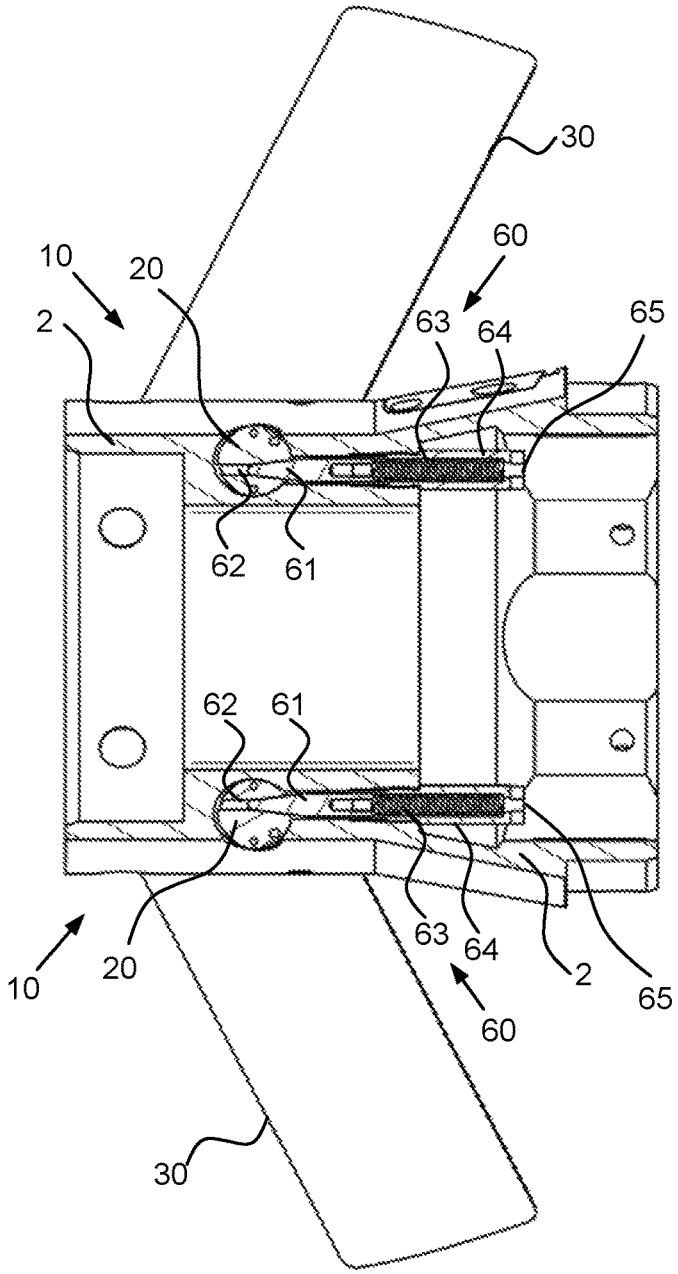
Figure 6A:
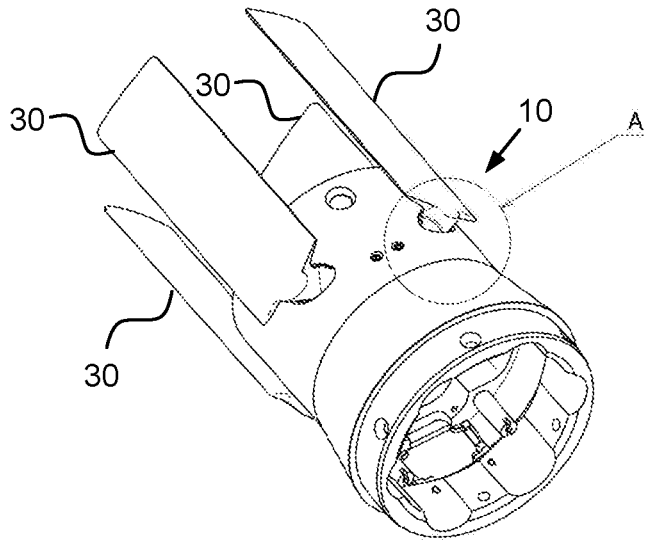
FIGS. 6*a*-6*b* schematically illustrate details of a wing arrangement according to an example.
Figure 6B:
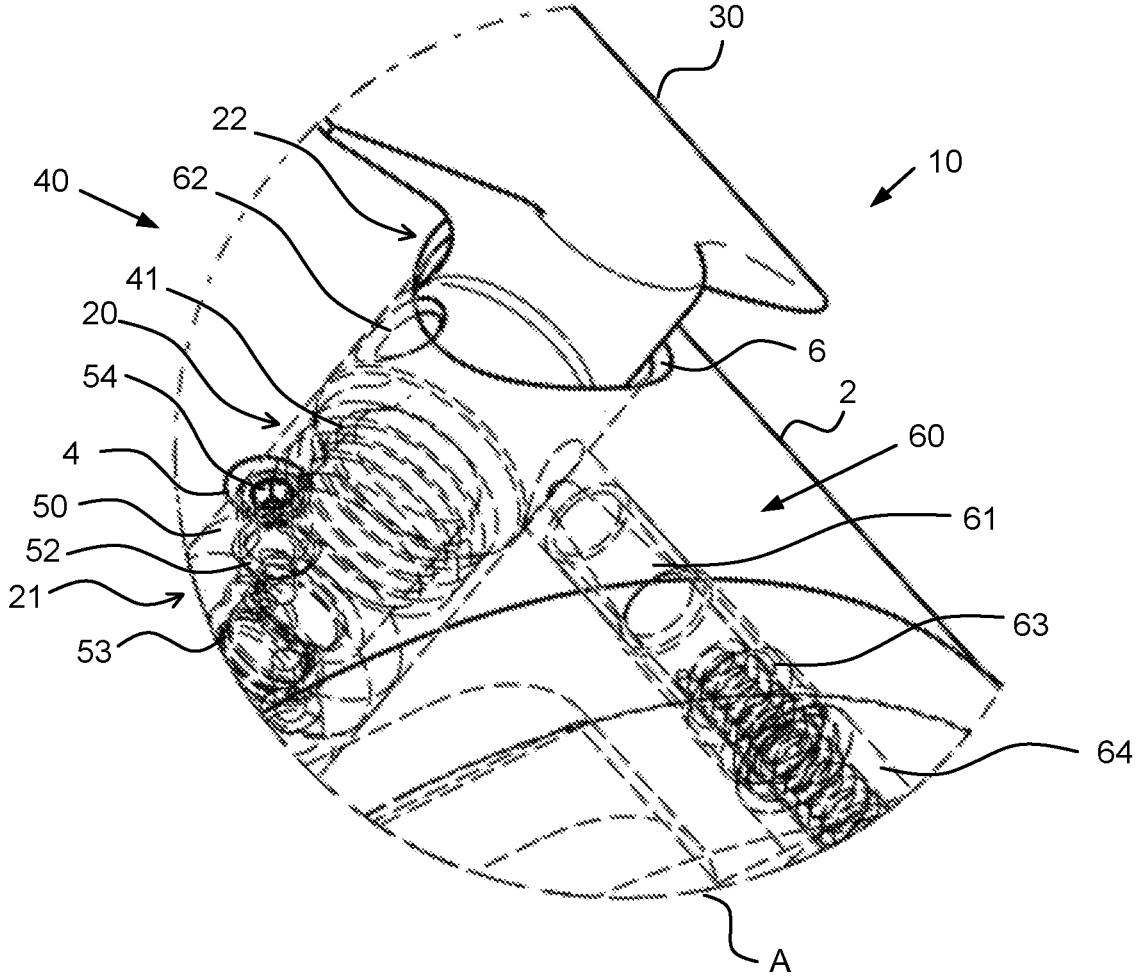

FIG. 5*b* shows a cross sectional view through section B-B, as illustrated in FIG. 5*a*. FIG. 6*b* shows a detailed view of zone A, as illustrated in FIG. 6*a*. FIGS. 4*a*-4*b* and 6*a*-6*b* show the wing arrangement 10 in the folded state with the locking arrangement 60 in an unlocked position. FIGS. 5*a*-5*b* shows the wing arrangement 10 in the deployed state with the locking arrangement 60 in a locked position. As shown in FIGS. 4*b* and 5*b*, the locking arrangement 60 may comprise a spring housing 64, wherein the spring housing 64 is configured to accommodate the at least one spring biased locking pin 61, 63. According to an example, the locking arrangement 60 may be reset from the locked position by retraction of the spring biased locking pin 61, 63 via the spring housing 64. According to an example, the spring housing 64 may comprise an reset opening 65 where a tool may be introduced in order to pull the spring biased locking pin 61, 63 back when the wing blade 30 is in the deployed state and the locking arrangement 60 is in the locked position, and thereby enable folding of the wing blade 30. According to an example, the at least one spring biased locking pin 61, 63 and the at least one corresponding locking slot 62 may have a conical shape.

According to an example, the locking arrangement 60 may be arranged at least partly within the circumferential wall 2 of the projectile 1. According to an example, the deployment arrangement 40 may be arranged at least partly within the circumferential wall 2 of the projectile 1. This means that the deployment arrangement 40 and/or the locking arrangement 60 may at least partly be surrounded by the circumferential wall 2.

As illustrated in FIG. 2, the torsion spring 41 may be a helical torsion spring 41. The torsion spring 41 may be arranged around the periphery of a portion of the wing shaft 20. FIGS. 2 and 3 show that the second end 43 of the torsion spring 41 may be configured to be coupled to the circumferential wall 2 via an annular socket 50 and a fastening arrangement 52, 53, 54. The annular socket 50 may be configured to be arranged around the periphery of a portion of the wing shaft 20. The outer radial surface of the annular socket 50 may act as a first guide surface 59. The first guide surface 59 may be favourable for load bearing and control of the rotational movement around the wing shaft axis R. An outer radial surface part of the distal end 22 of the wing shaft 20 may in a corresponding way act as a second guide surface 29. By means of having the first and second guide surfaces 59, 29 relatively far apart, a stable and secure mounting and rotation of the wing shaft 20 in relation to the circumferential wall 2 may be achieved.

Thus, the annular socket 50 may comprise a first guide surface 59 and the wing shaft 20 may comprise a second guide surface 29. The second guide surface 29 may abut the wing shaft aperture 6 in the circumferential wall 2. The first and second guide surfaces 29, 59 may be axially symmetric around the wing shaft axis R. The first and second guide surfaces 29, 59 may be arranged in parallel with the wing shaft axis R.

In FIGS. 2 and 3, it is shown that the fastening arrangement 52, 53, 54 may comprise a retaining device 53 for retaining the torsion spring 41 and the annular socket 50 axially in relation to the wing shaft 20. The retaining device 53 may comprise a retaining ring, a locking screw, a nut or any other suitable device. According to an example, the retaining device 53 may be configured to be arranged at the proximal end 21 of the wing shaft 20. According to an example, the fastening arrangement 52, 53, 54 may further comprise a fastening device 54 and a mating fastening part 52, wherein the fastening device 54 extends into the circumferential wall 2 and the mating fastening part 52 may be arranged in the annular socket 50. By means of the fastening device 54 and the mating fastening part 52 arranged in the annular socket 50, the wing arrangement 10 may be fastened in relation to the circumferential wall 2 of the projectile 1.

According to an example, the fastening device 54 may comprise a screw, a spring pin or any other suitable fastener. According to an example, the mating fastening part 52 in the annular socket 50 may comprise a recess, a screw threaded opening or any other suitable mating fastening part cooperating with the fastening device 53. The fastening device 54 may be accessible from the outside of the circumferential wall 2.

Figure 7A:
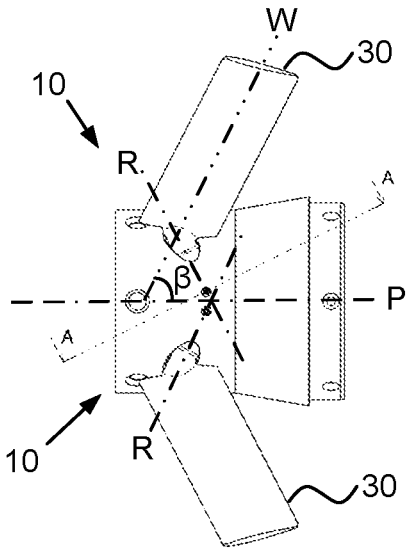
FIGS. 7*a*-7*b* schematically illustrate details of a wing arrangement according to an example.
Figure 7B:
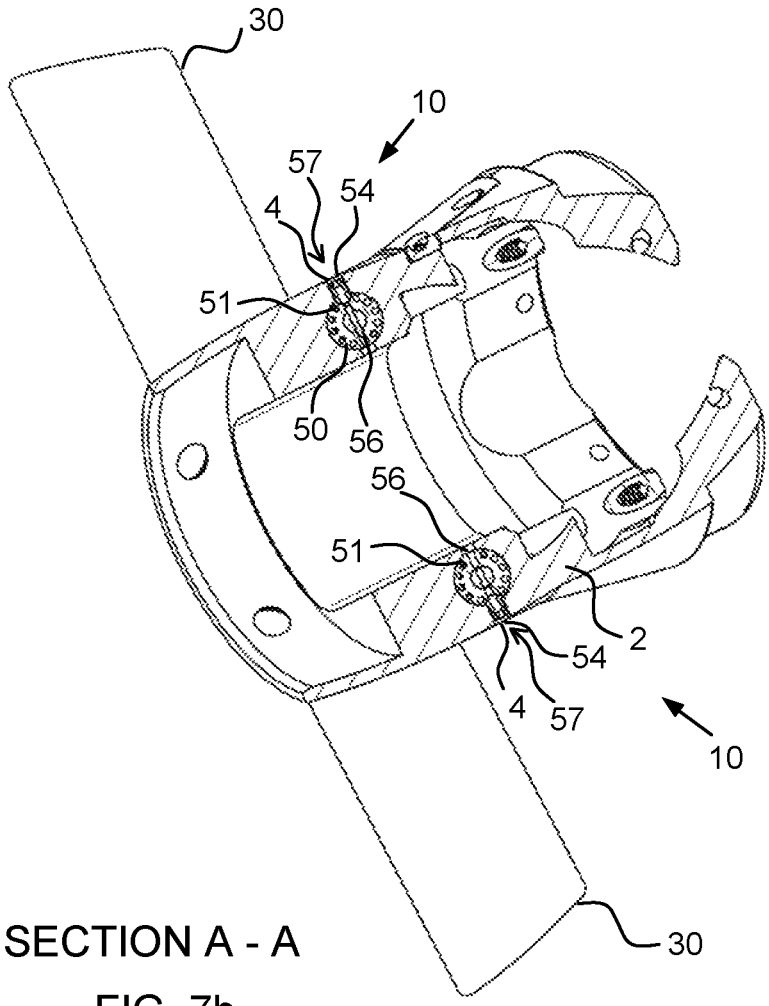
Figure 8A:
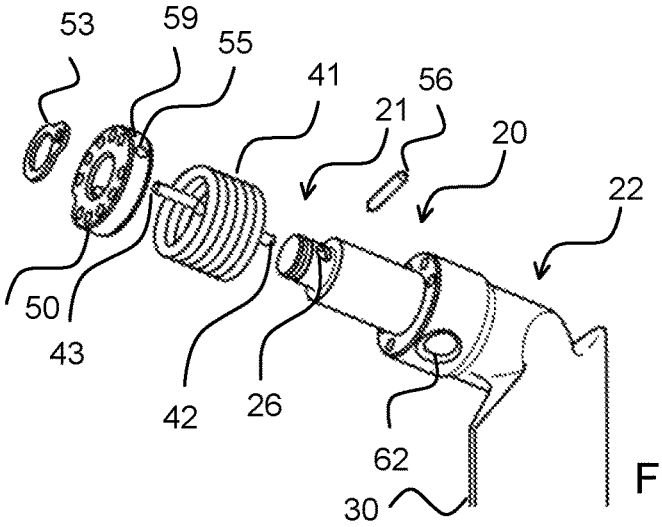
FIGS. 8*a*-8*f* schematically illustrate details of a wing arrangement according to an example.
Figure 8B:
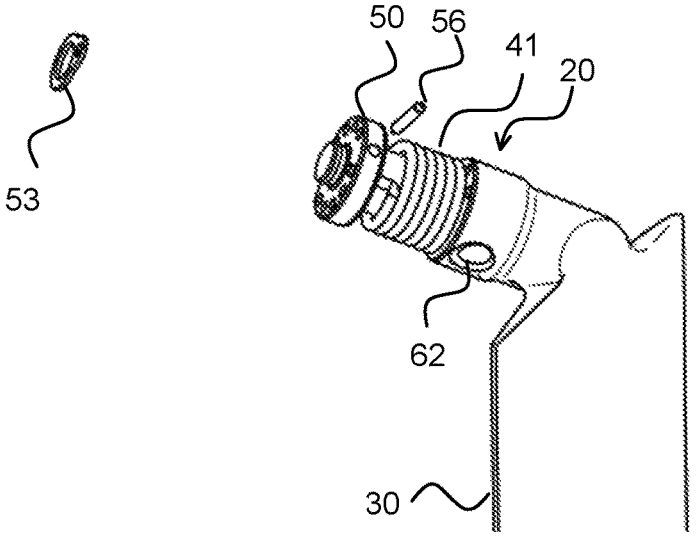
Figure 8C:
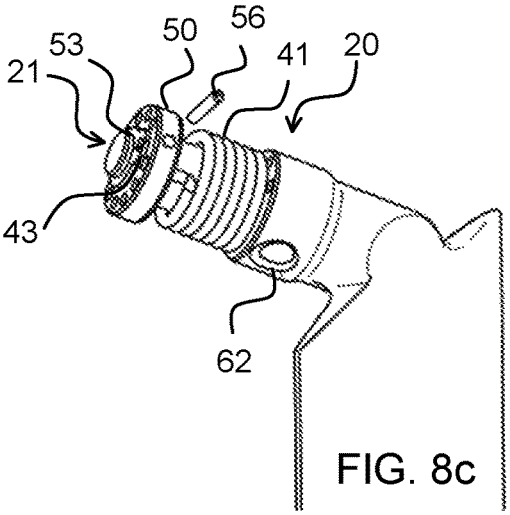
Figure 8D:
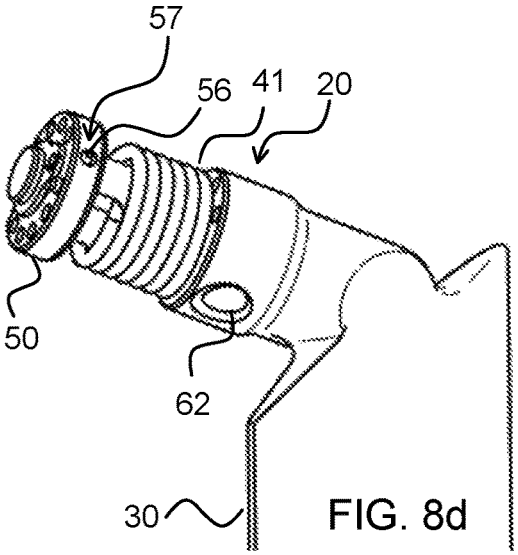
Figure 8E:
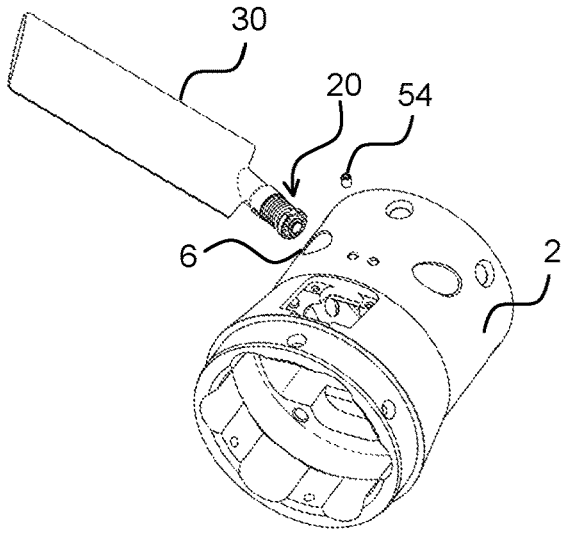
Figure 8F:
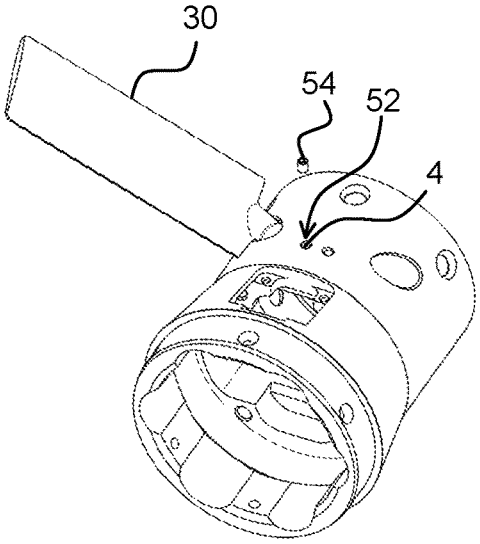
Figure 9A:
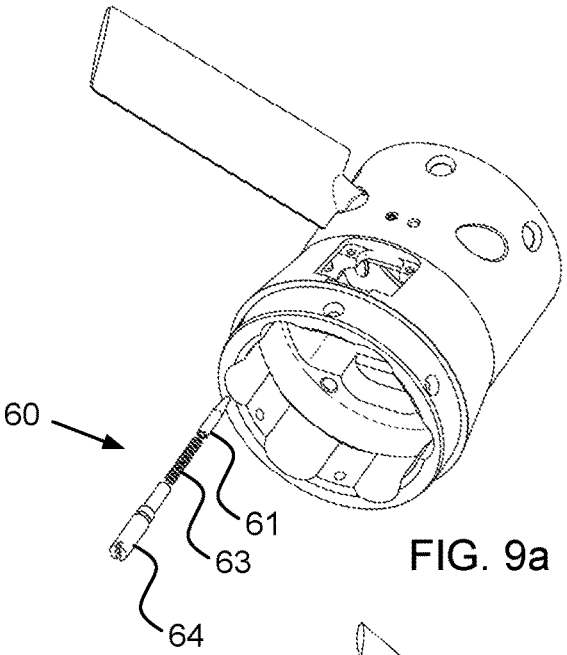
FIGS. 9*a*-9*b* schematically illustrate details of a wing arrangement according to an example.
Figure 9B:
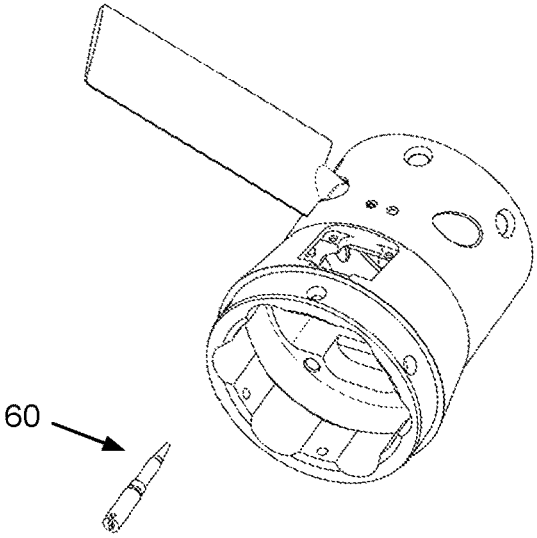
Figure 10:
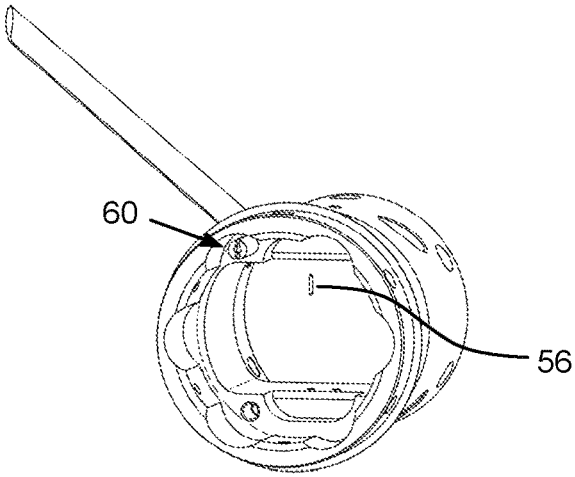
FIG. 10 schematically illustrates details of a wing arrangement according to an example.

FIGS. 7*a*-7*b* schematically illustrates a wing arrangement 10 according to an example of the present disclosure. The wing arrangement 10 may be configured as disclosed in FIG. 1*a*-1*d*, 2, 3, 4*a*-4*b*, 5*a*-5*b* and 6*a*-6*b*. FIG. 7*b* shows a cross sectional view through section A-A, as illustrated in FIG. 7*a*. The section A-A is perpendicular to the wing shaft axis R, through the annular socket 50. FIGS. 7*a*-7*b* show the wing arrangement 10 in the deployed state. As shown in FIGS. 2 and 7*a*-7*b*, the wing shaft 20 and the annular socket 50 may comprise corresponding radial holes 26, 55 forming a passage 57 when aligned, whereby the torsion spring 41 is pre-tensioned by fitting an assembly pin 56 into the passage 57 during assembly of the wing arrangement 10. The pre-tensioning obtained by means of the assembly pin 56 has previously been mentioned as the first pre-tensioning. The assembly pin 56 may be a temporary device which may only be used during assembly. The wing shaft 20 may be disabled from rotating as long as the assembly pin 56 is arranged in the passage. Thus, the assembly pin 56 may be removed after the wing shaft 20 has been mounted in the wing shaft aperture 6 in the circumferential wall 2 of the projectile 1 in the deployed state, in order to enable folding of the wing blade 30.

In FIG. 2, it is shown that the wing shaft 20 may comprise at least one first mounting hole 28 configured to receive the first end 42 of the torsion spring 41. By means of connecting the first end 42 of the torsion spring 41 to the wing shaft 20 by means of a fixed mounting hole 28, the assembly and pre-tensioning of the torsion spring 41 may be facilitated. According to an example, the at least one first mounting hole 28 may extend in parallel with the wing shaft axis R. Thus, the at least one first mounting hole 28 may extend along an axial direction of the wing shaft 20 and may thus be referred to the at least one first axial mounting hole 28. The at least one first mounting hole 28 may extend into a first mounting surface 27 of the wing shaft 20. The first mounting surface 27 may extend axially symmetric around the wing shaft axis R and in a plane perpendicular to the wing shaft axis R.

The annular socket 50 may comprise at least one second mounting hole 51 configured to receive the second end 42 of the torsion spring 41. The at least one second mounting hole 51 may extend in an axial direction of the annular socket 50 and may thus be referred to the at least one second axial mounting hole 51. According to an example, the at least one second mounting hole 51 may extend in parallel with the wing shaft axis R when the annular socket 50 is arranged on the wing shaft 20.

In FIG. 2, there are multiple first and second mounting holes 28, 51 shown. By means of multiple holes, the pre-tensioning may be adjusted depending on which mounting holes the ends of the torsion spring is positioned. However, according to an example, the wing arrangement components may be manufactured with one first mounting hole 28 and one second mounting hole 51. The benefits of having only one of each type of mounting hole reduces the risk of inaccurate pre-tensioning when assembling the wing arrangement 10. According to another example, the annular socket 50 may comprise two second mounting holes 51, in order to reduce the number of different components that have to be manufactured. Two second mounting holes 51 may allow for the same component to be used for pairwise arranged wing arrangements 10, i.e two adjacent wing arrangements 10 arranged with their proximal ends 21 of their wing shafts 20 pointing towards each other.

As schematically illustrated in FIG. 2, the wing blade 30 may extend longitudinally along a wing blade axis W, wherein the wing blade axis W is arranged at a first angle α in relation to the wing shaft axis R. According to an example, the wing blade axis W may be inclined with a first angle α in relation to the wing shaft axis R. According to an example, the first angle α may be an obtuse angle. Thus, the first angle α may be greater than 90° and less than 180°. According to examples, the first angle α may be between 95° to 170°, or 100° to 160°, or 105° to 150°, or 110° to 140°.

As schematically illustrated in e.g. FIG. 4*a*, the wing blade axis W of the wing blade 30 in the folded state may be arranged in parallel with a centre axis P of the projectile 1. As schematically illustrated in e.g. FIG. 5*a*, the wing blade axis W of the wing blade 30 in the deployed state may extend in a radial direction from the centre axis P of the projectile 1. According to an example, the wing blade axis W of the wing blade 30 in the deployed state may be arranged in a radial direction from the centre axis P and at a second angle β in relation to the centre axis P, leaning towards a rear end 4 of the projectile 1. Thus, the second angle β may be an acute angle, i.e. between 0° and 90°. According to examples, the second angle β may be between 5° to 90°, or 10° to 75°, or 15° to 50°. According to a specific example, the second angle β may be about 20°. According to an example, the second angle β may be variable and adjusted to the current application. According to an example, the wing blade 30 may be exchangeable. Thus, the wing blade 30 may be configured to be removably attached to the distal end 22 of the wing shaft 20.

According to the example, the projectile 1 may comprise at least four wing arrangements 10, wherein the wing arrangements 10 may be arranged pairwise on opposite sides of the projectile 1 (shown in e.g. FIGS. 1 and 3 and 7*a*). This means that two adjacent wing arrangements 10 may be arranged with their proximal ends 21 of their wing shafts 20 pointing towards each other. Arranging the wing arrangements 10 pairwise may save valuable space within the projectile 1. According to an example, the projectile 1 may comprise four wing arrangement 10, wherein the wing blades 30 may be arranged in a cross configuration (as shown in FIG. 1*b*) or a plus configuration in the deployed state.

Figure 12:
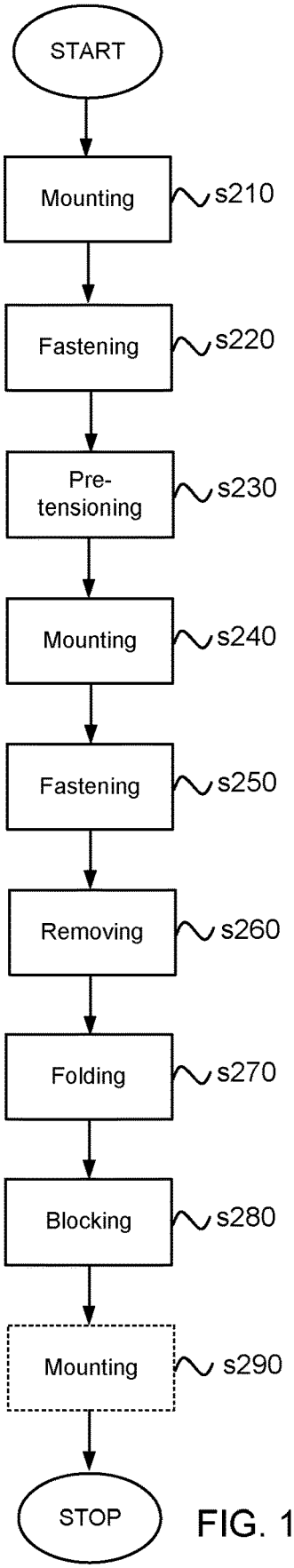
FIG. 12 schematically illustrates a block diagram of method steps according to examples.

FIGS. 8*a*-8*f*, 9*a*-9*b* and 10 schematically illustrates assembly of a wing arrangement 10 according to an example of the present disclosure. The wing arrangement 10 may be configured as disclosed in FIG. 1*a*-1*d*, 2, 3, 4*a*-4*b*, 5*a*-5*b*, 6*a*-6*b* and 7*a*-7*b*. The assembly of the wing arrangement 10 may described in more detail with reference to the method for assembly of a wing arrangement 10 as shown in FIG. 12.

Figure 11:
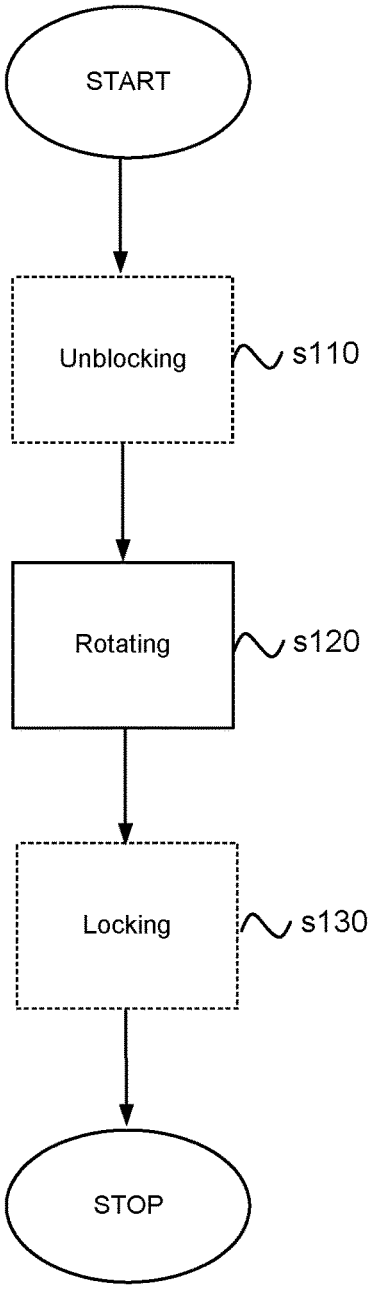
FIG. 11 schematically illustrates a block diagram of method steps according to examples.

FIG. 11 schematically illustrates a block diagram of a method for deploying a wing blade 30 for a projectile 1 by using a wing arrangement 10 according to an example. The method may relate to the wing arrangement 10 as disclosed in FIGS. 1*a*-1*d*, 2, 3, 4*a*-4*b*, 5*a*-5*b*, 6*a*-6*b*, 7*a*-7*b*, 8*a*-8*f*, 9*a*-9*b* and 10.

The method for deploying a wing blade 30 for a projectile 1 by using a wing arrangement 10 comprises the step of: rotating s120 the wing shaft 20 around the wing shaft axis R by release of stored spring force in the pre-tensioned torsion spring 41. According to an example, the stored spring force in the pre-tensioned torsion spring 41 may be released after launch of the projectile.

The release of stored spring force may be accomplished by removal of any blockage impeding the unfolding of the wing blade 30. When the projectile 1 is arranged in e.g. a lunch tube, the inner walls of the launch tube may act as a blocking device and counteract the deployment of the wing blades. However, when the projectile 1 is launched and exits the launch tube, the counteracting force applied by the inner walls of the launch tube restricting the rotational movement may be removed. Alternatively, the wing arrangement 10 may comprise a releasable blocking device wherein the release of the releasable blocking device may be actuated by a signal or a sensor at launch (not shown in the figures). For example, the sensor may indicate when the projectile 1 leaves the launch tube and a signal may actuate the release of stored spring force. Alternatively, the blocking device may be released after a predetermined time delay from the initiation of launch.

The release of the spring force may force the wing shaft 20 to rotate around the wing shaft axis R whereby the wing blade 30 may be deployed from the folded state to the deployed state. The deployment may further be assisted and/or accelerated by fluid resistance.

According to an example, the method may further comprise the step of: prior to rotating s120, unblocking s110 rotational movement of the wing blades 30 and/or the wing shaft 20. The unblocking of rotation movement may refer to removal or release of any blocking device, as previously disclosed herein.

According to an example, the method may further comprise the step of: locking s130 the wing arrangement 10 in the deployed state. According to an example, the wing arrangement 10 may be locked in the deployed state by means of a locking arrangement 60 as previously described herein, or any other suitable locking device.

FIG. 12 schematically illustrates a block diagram of a method for assembly of a wing arrangement 10 according to an example. The method may relate to the wing arrangement 10 as disclosed in FIGS. 1*a*-1*d*, 2, 3, 4*a*-4*b*, 5*a*-5*b*, 6*a*-6*b*, 7*a*-7*b*, 8*a*-8*f*, 9*a*-9*b* and 10. The wing arrangement 10 being configured to be altered between a folded state and a deployed state. The wing arrangement 10 comprising: a wing shaft 20 extending longitudinally between a proximal end 21 and a distal end 22 along a wing shaft axis R, the proximal end 21 being configured to be inserted into a wing shaft aperture 6 in a circumferential wall 2 of the projectile 1, the wing shaft 20 being rotatable around the wing shaft axis R; a wing blade 30 connected to the distal end 22 of the wing shaft 20, the wing blade 30 being configured to be folded towards the circumferential wall 2 of the projectile 1 in the folded state and to extend away from the circumferential wall 2 in the deployed state; a deployment arrangement 40 configured to control a rotational movement of the wing shaft 20 around the wing shaft axis R, whereby the wing blade 30 is deployed from the folded state to the deployed state, the deployment arrangement 40 comprising a pre-tensioned torsion spring 41 arranged coaxially with the wing shaft 20, wherein a first end 42 of the torsion spring 41 is coupled to the wing shaft 20 and a second end 43 of the torsion spring 41 is coupled to the circumferential wall 2, wherein the second end 43 of the torsion spring 41 is configured to be coupled to the circumferential wall 2 of the projectile 1 via an annular socket 50 and a fastening arrangement 52, 53, 54, the fastening arrangement 52, 53, 54 comprising a retaining device 53 for retaining the torsion spring 41 and the annular socket 50 axially in relation to the wing shaft 20, wherein the fastening arrangement 52, 53, 54 further comprises a fastening device 54 and a mating fastening part 52, wherein the fastening device 54 extends into the circumferential wall 2 and the mating fastening part 52 is arranged in the annular socket 50, the wing shaft 20 and the annular socket 50 comprise corresponding radial holes 26, 55 forming a passage 57 when aligned for an assembly pin 56.

The method as illustrated in FIG. 12 (and in FIGS. 8*a*-8*f*) comprising the steps of: mounting s210 the torsion spring 41 and the annular socket 50 around the wing shaft 20 (see FIG. 8*a*-8*b*); fastening s220 the retaining device 53 at the proximal end 21 of the wing shaft 20 (see FIGS. 8*b*-8*c*); pre-tensioning s230 the torsion spring 41 by aligning the radial holes 26, 55 in the annular socket 50 and the wing shaft 20 and fitting the assembly pin 56 into the passage 57 (see FIGS. 8*c*-8*d*); mounting s240 the wing shaft 20 in the wing shaft aperture 6 in the circumferential wall 2 with the wing blade 30 extending away from the circumferential wall 2 of the projectile 1 (see FIGS. 8*e*-8*f*); fastening s250 the fastening device 54 to the mating fastening part 52 (see FIG. 8*f*); removing s260 the assembly pin 56 (see FIG. 10); folding s270 the wing blade 30 towards the circumferential wall 2; and blocking s280 the deployment of the wing blade 30.

The wing arrangement 10 may further comprise a locking arrangement 60 for retaining the wing blade 30 in the deployed state, wherein the locking arrangement 60 comprises at least one spring biased locking pin 61, 63 and at least one corresponding locking slot 62, wherein the at least one locking slot 62 is arranged in the wing shaft 20. The method may further comprise the step of: mounting s290 the at least one spring biased locking pin 61, 63 in relation to the circumferential wall 2 (see FIGS. 9*a*-9*b*).

The foregoing description of the preferred examples of the present disclosure is provided for illustrative and descriptive purposes. It is not intended to be exhaustive or to restrict the invention to the variants described. Many modifications and variations will obviously be apparent to one skilled in the art. The examples of the present disclosure have been chosen and described in order best to explain the principles of the invention and its practical applications and hence make it possible for specialists to understand the invention for various embodiments and with the various modifications appropriate to the intended use.

The invention claimed is:

1. A wing arrangement (10) for a projectile (1), the wing arrangement (10) being configured to be altered between a folded state and a deployed state, the wing arrangement (10) comprising:

a wing shaft (20) extending longitudinally between a proximal end (21) and a distal end (22) along a wing shaft axis (R), the proximal end (21) being configured to be inserted into a wing shaft aperture (6) in a circumferential wall (2) of the projectile (1), the wing shaft (20) being rotatable around the wing shaft axis (R);

a wing blade (30) connected to the distal end (22) of the wing shaft (20), the wing blade (30) being configured to be folded towards the circumferential wall (2) of the projectile (1) in the folded state and to extend away from the circumferential wall (2) in the deployed state; and a deployment arrangement (40) configured to control a rotational movement of the wing shaft (20) around the wing shaft axis (R), whereby the wing blade (30) is deployed from the folded state to the deployed state, the deployment arrangement (40) comprising a pre-tensioned torsion spring (41) arranged coaxially with the wing shaft (20), wherein a first end (42) of the torsion spring (41) is coupled to the wing shaft (20) and a second end (43) of the torsion spring (41) is configured to be coupled to the circumferential wall (2) of the projectile (1) via an annular socket (50) and a fastening arrangement (52, 53, 54), wherein the fastening arrangement (52, 53, 54) comprises a retaining device (53) for retaining the torsion spring (41) and the annular socket (50) axially in relation to the wing shaft (20).

2. The wing arrangement (10) according to claim 1, wherein the wing arrangement (10) further comprises a locking arrangement (60) for retaining the wing blade (30) in the deployed state.

3. The wing arrangement (10) according to claim 2, wherein the locking arrangement (60) comprises at least one spring biased locking pin (61, 63) and at least one corresponding locking slot (62), wherein the at least one locking slot (62) is arranged in the wing shaft (20).

4. The wing arrangement (10) according to claim 1, wherein the torsion spring (41) is a helical torsion spring (41).

5. The wing arrangement (10) according to claim 1, wherein the wing shaft (20) and the annular socket (50) comprise corresponding radial holes (26, 55) forming a passage (57) when aligned, whereby the torsion spring (41) is pre-tensioned by fitting an assembly pin (56) into the passage (57) during assembly of the wing arrangement (10).

6. The wing arrangement (10) according to claim 1, wherein the wing shaft (20) comprises at least one first mounting hole (28) configured to receive the first end (42) of the torsion spring (41).

7. The wing arrangement (10) according to claim 1, wherein the annular socket (50) comprises at least one second mounting hole (51) configured to receive the second end (42) of the torsion spring (41).

8. The wing arrangement (10) according to claim 1, wherein the wing blade (30) is configured to, in the folded state, extend in a direction towards a front end (5) of the projectile (1).

9. The wing arrangement (10) according to claim 1, wherein the wing blade (30) extends longitudinally along a wing blade axis (W), wherein the wing blade axis (W) is arranged at a first angle (a) in relation to the wing shaft axis (R).

10. A method for deploying a wing blade (30) for a projectile (1) by using a wing arrangement (10) according to claim 1, the method comprising the step of:

rotating (s120) the wing shaft (20) around the wing shaft axis (R) by release of stored spring force in the pre-tensioned torsion spring (41).

11. Use of a wing arrangement (10) according to claim 1, for deployment of a wing blade (30) during launch of a projectile (1).

12. A projectile (1) comprising at least one wing arrangement (10) according to claim 1.

13. A method for assembly of a wing arrangement (10), the wing arrangement (10) being configured to be altered between a folded state and a deployed state, the method comprising:

providing a wing arrangement (10) comprising:

a wing shaft (20) extending longitudinally between a proximal end (21) and a distal end (22) along a wing shaft axis (R), the proximal end (21) being configured to be inserted into a wing shaft aperture (6) in a circumferential wall (2) of the projectile (1), the wing shaft (20) being rotatable around the wing shaft axis (R);

a wing blade (30) connected to the distal end (22) of the wing shaft (20), the wing blade (30) being configured to be folded towards the circumferential wall (2) of the projectile (1) in the folded state and to extend away from the circumferential wall (2) in the deployed state; and a deployment arrangement (40) configured to control a rotational movement of the wing shaft (20) around the wing shaft axis (R), whereby the wing blade (30) is deployed from the folded state to the deployed state, the deployment arrangement (40) comprising a pre-tensioned torsion spring (41) arranged coaxially with the wing shaft (20), wherein a first end (42) of the torsion spring (41) is coupled to the wing shaft (20) and a second end (43) of the torsion spring (41) is coupled to the circumferential wall (2), wherein the second end (43) of the torsion spring (41) is configured to be coupled to the circumferential wall (2) of the projectile (1) via an annular socket (50) and a fastening arrangement (52, 53, 54), the fastening arrangement (52, 53, 54) comprising a retaining device (53) for retaining the torsion spring (41) and the annular socket (50) axially in relation to the wing shaft (20), wherein the fastening arrangement (52, 53, 54) further comprises a fastening device (54) and a mating fastening part (52), wherein the fastening device (54) extends into the circumferential wall (2) and the mating fastening part (52) is arranged in the annular socket (50), the wing shaft (20) and the annular socket (50) comprise corresponding radial holes (26, 55) forming a passage (57) when aligned for an assembly pin (56);

mounting (s210) the torsion spring (41) and the annular socket (50) around the wing shaft (20);

fastening (s220) the retaining device (53) at the proximal end (21) of the wing shaft (20);

pre-tensioning (s230) the torsion spring (41) by aligning the radial holes (26, 55) in the annular socket (50) and the wing shaft (20) and fitting the assembly pin (56) into the passage (57);

mounting (s240) the wing shaft (20) in the wing shaft aperture (6) in the circumferential wall (2) with the wing blade (30) extending away from the circumferential wall (2) of the projectile (1);

fastening (s250) the fastening device (54) to the mating fastening part (52);

removing (s260) the assembly pin (56);

folding (s270) the wing blade (30) towards the circumferential wall (2); and blocking (s280) the deployment of the wing blade (30).

14. The method according to claim 13, wherein the wing arrangement (10) further comprises a locking arrangement (60) for retaining the wing blade (30) in the deployed state, wherein the locking arrangement (60) comprises at least one spring biased locking pin (61, 63) and at least one corresponding locking slot (62), wherein the at least one locking slot (62) is arranged in the wing shaft (20), and wherein the method further comprises the step of:

mounting (s290) the at least one spring biased locking pin (61, 63) in relation to the circumferential wall (2).

* * * * *